US006835520B2

(12) United States Patent
Bando et al.

(10) Patent No.: US 6,835,520 B2
(45) Date of Patent: Dec. 28, 2004

(54) APPARATUS FOR FORMING IMAGE

(75) Inventors: Koji Bando, Minamiashigara (JP); Masahiko Hodumi, Minamiashigara (JP); Takahiro Suzuki, Minamiashigara (JP); Kazuhiro Koseki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 24 days.

(21) Appl. No.: 10/290,300

(22) Filed: Nov. 8, 2002

(65) Prior Publication Data

US 2003/0157420 A1 Aug. 21, 2003

(30) Foreign Application Priority Data

Nov. 9, 2001 (JP) ..... 2001-345252

(51) Int. Cl.[7] ..... G03G 13/16; G03G 15/16

(52) U.S. Cl. ..... 430/124; 430/66; 399/159; 399/302; 399/308

(58) Field of Search ..... 430/124, 66, 47, 430/58.2; 399/159, 302, 308

(56) References Cited

U.S. PATENT DOCUMENTS

| | | | | |
|---|---|---|---|---|
| 5,430,526 | A | | 7/1995 | Ohkubo et al. |
| 5,879,847 | A | | 3/1999 | Yoshinaga et al. |
| 6,144,817 | A | * | 11/2000 | Takeuchi et al. ..... 399/51 |
| 6,336,025 | B1 | * | 1/2002 | Saeki ..... 399/301 |
| 6,352,809 | B1 | | 3/2002 | Nukada et al. |
| 2002/0115012 | A1 | | 8/2002 | Hashizume et al. |
| 2003/0054271 | A1 | | 3/2003 | Yao et al. |
| 2003/0118366 | A1 | | 6/2003 | Nukada et al. |

FOREIGN PATENT DOCUMENTS

| | | |
|---|---|---|
| JP | A 47-30330 | 11/1972 |
| JP | A 61-238062 | 10/1986 |

(List continued on next page.)

OTHER PUBLICATIONS

Weiss et al., "Analysis of Electrostatic Latent Image Blurring Caused by Photoreceptor Surface Treatments," *Proceedings of IS&T's Eleventh International Congress on Advances in Non–Impact Printing Technologies*, pp. 57–59.

Weiss et al., "Analysis of Electrostatic Latent Image Blurring Caused by Photoreceptor Surface Treatments," *Journal of Imaging Science and Technology*, vol. 40, No. 4, Jul./Aug. 1996, pp. 322–326.

*Primary Examiner*—John L Goodrow
(74) *Attorney, Agent, or Firm*—Oliff & Berridge, PLC

(57) ABSTRACT

An apparatus for forming an image is provided that can sufficiently prevent occurrence of nibbled images without any damage of the photoreceptor and the intermediate transfer body, whereby good image quality can be stably obtained for a long period of time. In an apparatus for forming an image having an intermediate transfer body, the surface of the photoreceptor has a dynamic hardness of $8\times10^9$ N/m$^2$ or more, and the surface of the intermediate transfer body has a dynamic hardness larger than that of the surface of the photoreceptor, and a difference between the dynamic hardness of the surface of the photoreceptor and the dynamic hardness of the surface of the intermediate transfer material is $2\times10^{10}$ N/m$^2$ or less.

12 Claims, 2 Drawing Sheets

U.S. PATENT DOCUMENTS

| | | |
|---|---|---|
| JP | A 62-108260 | 5/1987 |
| JP | A 63-194272 | 8/1988 |
| JP | A 1-161279 | 6/1989 |
| JP | A 1-177063 | 7/1989 |
| JP | A 2-198476 | 8/1990 |
| JP | A 2-212867 | 8/1990 |
| JP | A 2-213882 | 8/1990 |
| JP | A 3-242667 | 10/1991 |
| JP | A 4-189873 | 7/1992 |
| JP | A 4-273252 | 9/1992 |
| JP | A 4-284479 | 10/1992 |
| JP | A 4-303869 | 10/1992 |
| JP | A 4-303872 | 10/1992 |
| JP | A 4-346365 | 12/1992 |
| JP | A 5-43813 | 2/1993 |
| JP | A 5-98181 | 4/1993 |
| JP | A 5-140472 | 6/1993 |
| JP | A 5-140473 | 6/1993 |
| JP | A 5-193020 | 8/1993 |
| JP | A 5-263007 | 10/1993 |
| JP | A 5-279591 | 10/1993 |
| JP | A 6-75384 | 3/1994 |
| JP | A 7-311470 | 11/1995 |
| JP | A 7-333881 | 12/1995 |
| JP | A 8-176293 | 7/1996 |
| JP | A 8-208820 | 8/1996 |
| JP | A 8-211755 | 8/1996 |
| JP | A 8-319353 | 12/1996 |
| JP | A 9-190004 | 7/1997 |
| JP | A 2001-345252 | 12/2001 |
| JP | 2002-318459 | * 10/2002 |

* cited by examiner

APPARATUS FOR FORMING IMAGE

BACKGROUND OF THE INVENTION

1. Field of the Invention

The present invention relates to an apparatus for forming an image, and more particularly, it relates to an apparatus for forming an image equipped with an intermediate transfer body.

2. Description of the Related Art

In a conventional apparatus for forming an image utilizing an electrophotographic process, image formation is carried out in the following manner. A charged electrophotographic photoreceptor is irradiated with exposure light to form an electrostatic latent image. The electrostatic latent image is developed with a toner, and a toner image thus formed is transferred to a transfer medium, such as paper. The photoreceptor after transferring is subjected to, depending on necessity, removal of the remaining toner with a cleaning device, and then again used in the next image formation process.

The transferring method for the apparatus for forming an image is roughly classified into two methods, i.e., a method where a toner image on the surface of the photoreceptor is directly transferred to a transfer material and a method where a toner image on the surface of the photoreceptor is primarily transferred to an intermediate transfer body, and the primarily transferred image is then secondarily transferred to a transfer material (intermediate transfer method). In the intermediate transfer method among these, it is possible that toner images of prescribed colors (e.g., black, cyan, magenta and yellow) are formed through color separation of a color original image, and the images are transferred as accumulated on the intermediate transfer body to reproduce the color image. Therefore, the method is widely utilized in an apparatus for forming a full color image.

However, it is considerably difficult in the intermediate transfer method that all the toner images of the respective colors are reliably transferred, and there are some cases where the color of the original image is not faithfully reproduced, and nibbled parts are formed on the reproduced image, due to the local transfer failure caused on the primary transferring steps of the respective colors.

In order to avoid such phenomena, accordingly, various measures for improving the transfer property on the primary transferring step have been studied. For example, JP-A-63-194272, JP-A-3-242667, JP-A-4-303869, JP-A-4-303872 and JP-A-5-193020 disclose techniques for improving adhesion between the photoreceptor and the intermediate transfer body by roughening the surface of the intermediate transfer body. JP-A-2-213882 discloses a technique that the linear velocity of the photoreceptor is differentiated from the linear velocity of the intermediate transfer body, and the transfer property on the primary transferring step is improved by both a mechanical force caused by the difference in linear velocity and an electric force by the transferring electric field. Furthermore, such measures are disclosed as a method of controlling the transferring nip pressure (JP-A-1-177063 and JP-A-4-284479, etc.), a method of lowering the wettability of the intermediate transfer body to improve the transfer property (JP-A-2-198476 and JP-A-2-212867), and a method of making the surface tension of the intermediate transfer body larger than the surface tension of the photoreceptor (JP-A-8-211755).

However, it is not always easy that occurrence of nibbled images is sufficiently prevented even by the conventional apparatus for forming an image described in the foregoing. Furthermore, in the method where the surface of the intermediate transfer material is roughened, and difference in linear velocity is provided between the photoreceptor and the intermediate transfer body, wear and damages are liable to occur on the surfaces of the photoreceptor and the intermediate transfer body, whereby the service life of the apparatus is shortened by these methods.

SUMMARY OF THE INVENTION

The invention is developed in view of the problems associated with the conventional techniques and is to provide an apparatus for forming an image that can sufficiently prevent occurrence of nibbled images without any damage of the photoreceptor and the intermediate transfer body, whereby good image quality can be stably obtained for a long period of time.

As a result of earnest investigations made by the inventors to attain the invention, it has been found that occurrence of nibbled images in the conventional apparatus for forming an image is ascribed to the combination use of the photoreceptor having a soft surface and the intermediate transfer body having a hard surface, i.e., the difference in surface hardness between the photoreceptor and the intermediate transfer body. Furthermore, as a result of investigations based on the findings, it has also found that the problems are solved by using a combination of a photoreceptor and an intermediate transfer body that satisfy particular conditions of dynamic hardness on the surfaces, and thus the invention has been completed.

Accordingly, the invention provides, as one aspect, an apparatus for forming an image containing an electrophotographic photoreceptor having an electroconductive support having a photosensitive layer formed thereon, a charging unit for charging a surface of the photoreceptor, an exposing unit for exposing the surface of the photoreceptor to form an electrostatic latent image, a developing unit for developing the electrostatic latent image with a toner to form a toner image, and a transferring unit for primarily transferring the toner image to an intermediate transfer body and for secondarily transferring a primary transferred image on the intermediate transfer body to a transfer material, the surface of the photoreceptor having a dynamic hardness of $8\times10^9$ N/m$^2$ or more, a surface of the intermediate transfer body having a dynamic hardness larger than that of the surface of the photoreceptor, and a difference between the dynamic hardness of the surface of the photoreceptor and the dynamic hardness of the surface of the intermediate transfer material being $2\times10^{10}$ N/m$^2$ or less.

In the apparatus for forming an image according to the invention, an electrostatic latent image is formed by exposure of the charged photoreceptor, and the electrostatic latent image is developed to form a toner image on the surface of the photoreceptor. The toner image is primarily transferred from the photoreceptor to the intermediate transfer body and further secondarily transferred from the intermediate transfer body to the transfer material. When the surfaces of the photoreceptor and the intermediate transfer body satisfy the foregoing conditions in dynamic hardness, at this time, the toner image can be sufficiently and uniformly transferred without any damage on the photoreceptor and the intermediate transfer body. Therefore, according to the apparatus for forming an image of the invention, occurrence of image defects, such as nibbled images, can be sufficiently prevented, and images of good conditions can be stably obtained for a long period of time.

The term dynamic hardness referred to herein means a value measured in the following manner. A microhardness measuring apparatus equipped with a diamond indenter having an edge angle of 115° and a tip end curvature radius of 0.1 $\mu$m is used, and the diamond indenter is penetrated on the surface of the photoreceptor or the intermediate transfer body at a stress velocity of 0.05 N/sec to measure the penetration depth (m) and the penetration load (N). The dynamic hardness ($N/m^2$) is obtained from the resultant values by using the following equation (a).

$$DH=3.8584P/D^2 \quad (a)$$

wherein DH represents the dynamic hardness ($N/m^2$), P represents the penetration load (N), and D represents the penetration depth (m).

It is preferred in the invention that the surface of the intermediate transfer body has a dynamic hardness of $1.8\times10^{10}$ $N/m^2$ or more. When the dynamic hardness of the surface of the intermediate transfer body satisfies the conditions, occurrence of image defects, such as nibbled images, can be further sufficiently prevented.

It is also preferred in the invention that the photosensitive layer of the photoreceptor has a protective layer on a farther side from the support, and when the protective layer and the intermediate transfer body are formed on glass supports, respectively, the surface of the intermediate transfer body has a dynamic hardness larger than a dynamic hardness of a surface of the protective layer, and a difference between the dynamic hardness of the surface of the protective layer and the dynamic hardness of the surface of the intermediate transfer body is $1.5\times10^{10}$ $N/m^2$ or less. According to the configuration, occurrence of nibbled images and damages on the photoreceptor and the intermediate transfer body can be further sufficiently prevented. The term dynamic hardness referred to in this embodiment means the same value in terms of $N/m^2$ referred in the foregoing except that the stress velocity is 0.09 N/sec.

It is also preferred in the invention that the protective layer contains a polysiloxane resin having charge transporting property and a crosslinked structure. When a polysiloxane resin is contained in the protective layer, the mechanical and electrical strength of the surface of the photoreceptor is improved, whereby the service life of the apparatus for forming an image of the invention can be prolonged.

It is also preferred in the invention that the intermediate transfer body contains a polyimide resin. When a polyimide resin is contained in the intermediate transfer body, the mechanical and electrical strength of the intermediate transfer body is improved, whereby the service life of the apparatus for forming an image of the invention can be prolonged. Furthermore, in the case where plural color toners having different colors are used in the apparatus for forming an image of the invention, color drift of the toner images of the respective colors can be certainly prevented, whereby reproducibility in color can be improved.

The invention also provides, as another aspect, a process for forming an image containing steps of: charging an electrophotographic photoreceptor having a surface having a dynamic hardness of $8\times10^9$ $N/m^2$ or more; exposing the charged surface of the electrophotographic photoreceptor to form an electrostatic latent image; developing the electrophotographic latent image with a toner to form a toner image; primarily transferring the toner image to an intermediate transfer body having a surface having a dynamic hardness larger than that of the surface of the photoreceptor, with a difference between the dynamic hardness of the surface of the photoreceptor and the dynamic hardness of the surface of the intermediate transfer material being $2\times10^{10}$ $N/m^2$ or less; and secondarily transferring a primary transferred image on the intermediate transfer body to a transfer material.

BRIEF DESCRIPTION OF THE DRAWINGS

Preferred embodiments of the invention will be described in detail based on the following figures, wherein.

DETAILED DESCRIPTION OF THE PREFERRED EMBODIMENTS

Preferred embodiments of the invention will be described in more detail with reference to the figures in some cases. In the figures, the same symbols are attached to the same or equivalent parts, and redundant descriptions are omitted.

Figure 1:
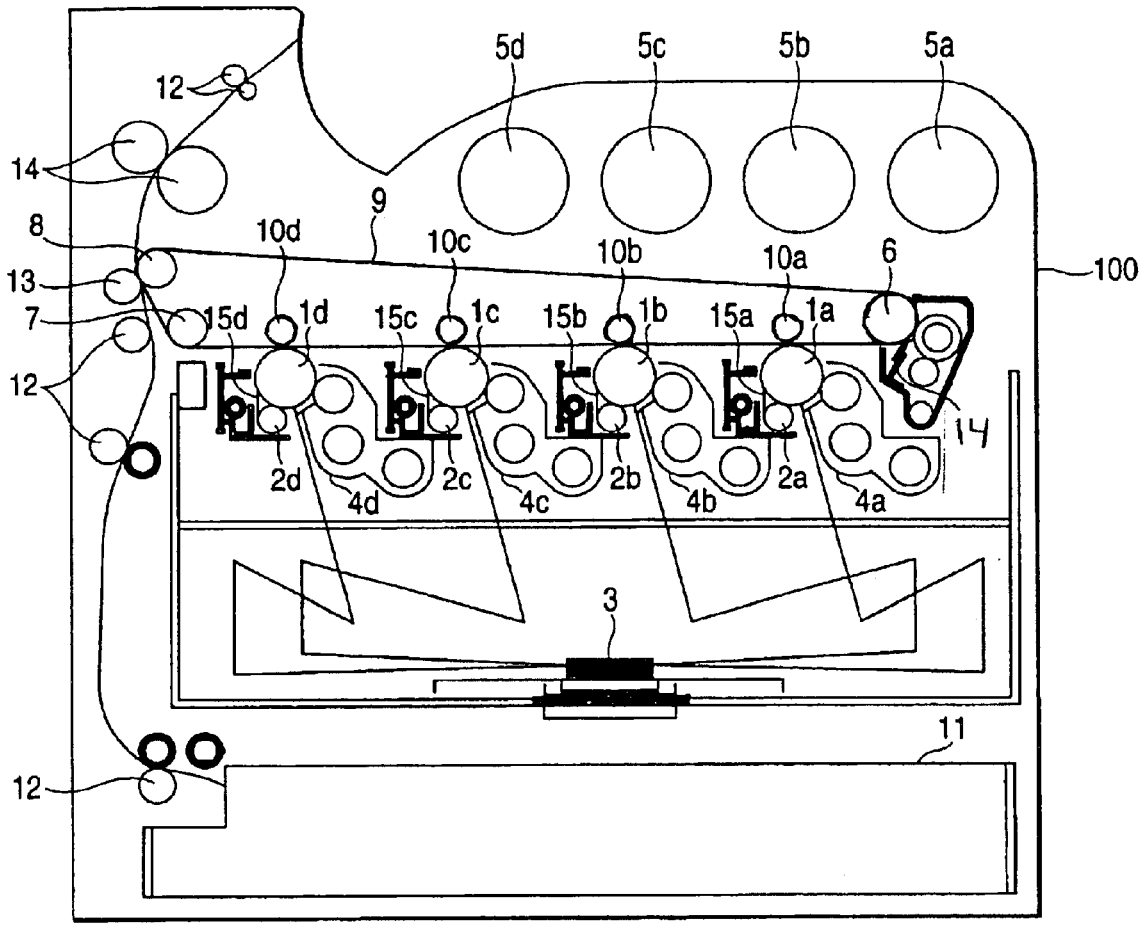
FIG. 1 is a schematic structural view showing a preferred embodiment of the apparatus for forming an image according to the invention.

FIG. 1 is a schematic structural view showing a preferred embodiment of the apparatus for forming an image according to the invention. The apparatus shown in FIG. 1 is a so-called tandem image forming apparatus, in which four electrophotographic photoreceptors 1*a* to 1*d* are arranged in parallel with each other along an intermediate transfer belt 9 inside a housing 100.

The photoreceptors 1*a* to 1*d* each is rotatable in a prescribed direction (counterclockwise in the figure), and charging rolls 2*a* to 2*d*, developing devices 4*a* to 4*d*, primary transfer rolls 10*a* to 10*d*, and cleaning blades 15*a* to 15*d* are arranged along the rotation direction thereof. Toners of four colors, i.e., black, yellow, magenta and cyan, contained in toner cartridges 5*a* to 5*d*, respectively, can be supplied to the developing devices 4*a* to 4*d*, respectively, and the primary transfer rolls 10*a* to 10*d* are in contact with the photoreceptors 1*a* to 1*d*, respectively, through the intermediate transfer body 9. A laser light source 3 is arranged at a prescribed position inside the housing 100, and the surfaces of the photoreceptors 1*a* to 1*d* can be irradiated with laser light emitted from the laser light source 3. According to the configuration, the charging, exposing, developing, primarily transferring and cleaning steps are sequentially carried out upon rotation of the photoreceptors 1*a* to 1*d*, whereby the toner images of the respective colors are transferred and accumulated on the intermediate transfer belt 9.

The intermediate transfer belt 9 is supported with a prescribed tension by a driving roll 6, a backup roll 7 and a tension roll 8, and can be rotated by rotation of the rolls without slack. A secondary transfer roll 13 is arranged to be in contact with the backup roll 7 through the intermediate transfer body 9. The intermediate transfer belt 9 having passed between the backup roll 7 and the secondary transfer roll 13 is cleaned with a cleaning blade 15*e* and then reused in the next image formation process.

A tray 11 is arranged at a prescribed position inside the housing 100, and a transfer material (such as paper) contained in the tray 11 is transported with a transporting roll 12 between the intermediate transfer belt 9 and the secondary transfer roll 13 and between two fixing rolls 14 in contact with each other and then delivered outside the housing 100.

Electrophotographic Photoreceptor

Figure 2:
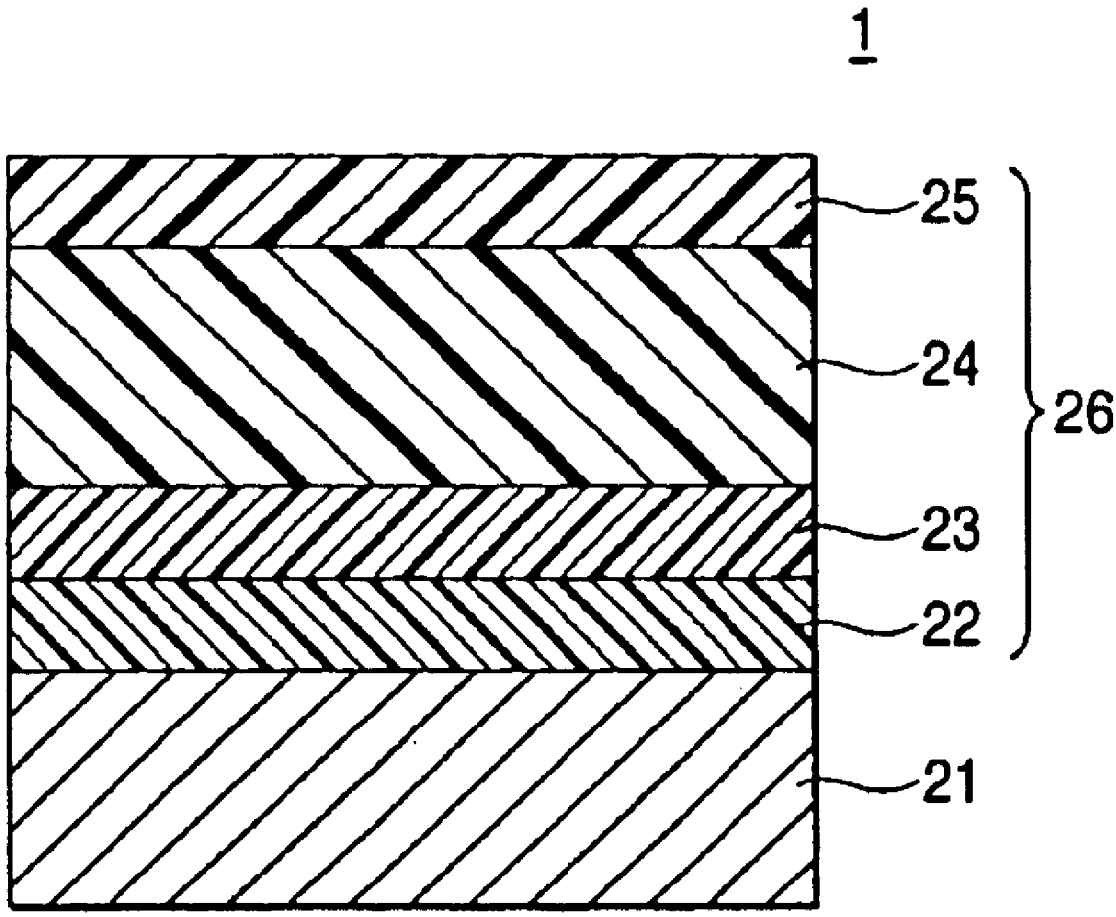
FIG. 2 is a schematic cross sectional view showing a preferred embodiment of the electrophotographic photoreceptor according to the invention.

FIG. 2 is a schematic cross sectional view showing a structure of the photoreceptors 1*a* to 1*d* (which are simply referred to as a "photoreceptor 1" in the description for FIG. 2). As shown in FIG. 2, an undercoating layer 22, a charge generating layer 23, a charge transporting layer 24 and a protective layer 25 are consecutively accumulated on an electroconductive support 21 to form a photosensitive layer 26, and the protective layer 25 contains a crosslinked material having a skeleton that contains an organic group having charge transporting property, a silicon atom bonded to the same or different carbon atom in the organic group, and an oxygen atom bonded to the silicon atom. The dynamic hardness on the surface of the photoreceptor 1 is set at $8.0\times10^9$ N/m$^2$ or more. The dynamic hardness can be adjusted by appropriately selecting the materials (such as a binder resin) of the layers 22 to 25 constituting the photosensitive layer 26 and the hardening conditions of the binder resin.

The electroconductive support 21 is formed with aluminum shaped into a cylindrical form (a drum form). The support 21 may be an untreated aluminum cylinder, and one having an outer surface being subjected to a surface treatment, such as an anodic oxidation treatment, a treatment with an acidic treating solution and a boehmite treatment, is preferably used.

The anodic oxidation treatment is to form an oxide film on the aluminum surface by carrying out anodic oxidation in an electrolyte solution with aluminum as an anode, and examples of the electrolyte solution include a sulfuric acid solution and an oxalic acid solution, etc. The anodic oxide film thus formed is liable to be contaminated and suffers large resistance variation depending on environments because it is porous and chemically active, and therefore, a sealing treatment is carried out in that fine pores of the anodic oxide film are sealed by cubical expansion caused by a hydration reaction in pressurized water vapor or boiled water (to which a metallic salt, such as a nickel salt, may be added) to transform into a more stable hydrated oxide. The thickness of the anodic oxide film is preferable from 0.3 to 15 $\mu$m. When the thickness is less than 0.3 $\mu$m, there is a tendency that the barrier property with respect to charge injection is low to fail to obtain sufficient effects. When the thickness exceeds 15 $\mu$m, there is a tendency that the residual potential upon repeated use in the image formation process is increased.

In the treatment with an acidic treating solution, such an acid as phosphoric acid, chromic acid and hydrofluoric acid is used. The mixing ratio of the acid component in the treating solution is preferable from 10 to 11% by weight for phosphoric acid, from 3 to 5% by weight for chromic acid, and from 0.5 to 2% by weight for hydrofluoric acid, and the total mixing ratio in the case where two or more kinds of acids are used is preferable from 3.5 to 8% by weight. The treating temperature is preferable from 42 to 48° C., and under the conditions, a film having a sufficient thickness can be efficiently obtained. The thickness of the film is preferable 0.3 to 15 $\mu$m. When the thickness is less than 0.3 $\mu$m, there is a tendency that the barrier property with respect to charge injection is low to fail to obtain sufficient effects. When the thickness exceeds 15 $\mu$m, there is a tendency that the residual potential upon repeated use in the image formation process is increased.

The boehmite treatment can be carried out by immersing in pure water at a temperature of from 90 to 100° C. for a period of from 5 to 60 minutes or by making in contact with heated water vapor at a temperature of from 90 to 120° C. for a period of from 5 to 60 minutes. The thickness of the film thus formed is preferable from 0.1 to 5 $\mu$m. The film may be further subjected to an anodic oxidizing treatment by using an electrolyte solution having a low solubility to the film, such as adipic acid, boric acid, a borate, a phosphate, a phthalate, a maleate, a benzoate, a tartrate and a citrate.

In the case where a laser light source is used as the exposing device 3, it is preferred that the outer surface of the support 21 is roughened to have a center line average roughness Ra of from 0.04 to 0.5 $\mu$m in order to prevent interference fringes formed upon irradiation with laser light. The surface roughening can be preferably carried out by wet honing, in which an abrasive suspended in water is blown onto the support 21, or centerless grinding, in which the support is continuously ground by pressing the support onto rotating grind stone. When Ra is less than 0.04 $\mu$m, the surface approaches a mirror surface, and there is a tendency that the interference preventing effect cannot be obtained. When Ra exceeds 0.5 $\mu$m, there is a tendency that the resulting image has coarse image quality even when the film is formed. In the case where a light source emitting non-interference light is used as the exposing device 3, the surface roughening for preventing interference fringes is not particularly necessary, and in this case, occurrence of defects due to unevenness on the surface of the support can be prevented to prolong the service life thereof.

Examples of the material for the support 21 include, in addition to aluminum, a metallic material, such as stainless steel and nickel; a material obtained by subjecting an electrically insulating material, such as a polymer material, e.g., polyethylene terephthalate, polybutylene terephthalate, polypropylene, nylon, polystyrene and a phenol resin, and hard paper, to an electroconductive treatment by dispersing an electroconductive substance therein; a material formed by accumulating a metallic foil the insulating material; and a material obtained by forming a deposition film of a metal on the insulating material. The shape of the support may also be a sheet form or a plate form.

Examples of the material for the undercoating layer 22 include an organic zirconium compound, such as a zirconium chelate compound, a zirconium alkoxide compound and a zirconium coupling agent, an organic titanium compound, such as a titanium chelate compound, a titanium alkoxide compound, and a titanate coupling agent, and an organic aluminum compound, such as an aluminum chelate compound and an aluminum coupling agent, and further include an organic metallic compound, such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound and an aluminum zirconium alkoxide compound, and among these, an organic zirconium compound, an organic titanyl compound and an organic aluminum compound are preferably used since they have a low residual potential to exhibit good electrophotographic characteristics.

A silane coupling agent may also be contained in the undercoating layer, examples of which include vinyltrichlorosilane, vinyltrimethoxysilane, vinyltriethoxysilane, vinyl-tris-2-methoxyethoxysilane, vinyltriacetoxysilane, γ-glycidoxypropyltrimethoxysilane, γ-methacryloxypropyltrimethoxysilane, γ-aminopropyltrimethoxysilane, γ-chloropropyltrimethoxysilane, γ-2-aminoethylpropyltrimethoxysilane, γ-mercaptopropyltrimethoxysilane, γ-ureidopropyltriethoxysilane and β-3,4-epoxycyclohexyltrimethoxysilane.

Furthermore, a binder resin may also be used, examples of which include polyvinyl alcohol, polyvinyl methyl ether, poly-N-vinylimidazole, polyethylene oxide, ethylcellulose, methylcellulose, an ethylene-acrylic acid copolymer, polyamide, polyimide, casein, gelatin, polyethylene, polyester, a phenol resin, a vinyl chloride-vinyl acetate copolymer, an epoxy resin, polyvinylpyrrolidone, polyvinylpyridine, polyurethane, polyglutamic acid and polyacrylic acid. The mixing ratio thereof may be appropriately selected depending on necessity.

An electron transporting substance may be used in the undercoating layer 21 through dispersion. Examples of the electron transporting substance include an organic pigment, such as a perylene pigment disclosed in JP-A-47-30330, a benzimidazole perylene pigment, a polycyclic quinone pigment, an indigo pigment and a quinacridone pigment; another organic pigment, such as a bisazo pigment and a phthalocyanine pigment having an electron withdrawing substituent, such as a cyano group, a nitro group, a nitroso group and a halogen atom; and an inorganic pigment, such as zinc oxide and titanium oxide. Among these pigments, a perylene pigment, a benzimidazole perylene pigment and a polycyclic quinone pigments are preferably used owing to the high electron transporting property thereof. When the amount of the electron transporting pigment is too large, the strength of the undercoating layer is lowered to cause defects on the coated film, and therefore, the mixing amount thereof is preferable 95% by weight or less, and more preferable 90% by weight or less. As the method for mixing and dispersing the charge transporting substance, an ordinary method using a ball mill, a roll mill, a sand mill, an attritor or an ultrasonic wave can be applied. The mixing and dispersing operation is carried out in an organic solvent, and an arbitrary organic solvent can be used therefor as far as it dissolves the organic metallic compound and the binder resin and does not cause gelation or aggregation upon mixing and dispersing the electron transporting pigment. For example, an ordinary organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used solely or in combination of two or more kinds of them.

The thickness of the undercoating layer 22 is preferable from 0.1 to 20 $\mu$m, and more preferable from 0.2 to 10 $\mu$m. As the coating method for providing the undercoating layer, an ordinary method, such as a blade coating method, a Mayer-bar coating method, a spray coating method, a dip coating method, a bead coating method, an air knife coating method and a curtain coating method, can be used. The coated film is dried to form the undercoating layer. In general, the drying operation is carried out, after evaporating a solvent, at a temperature that the film can be formed. In particular, the undercoating layer is preferably formed on a support having been subjected to the acidic solution treatment and the boehmite treatment because the supports are liable to be insufficient in defect hiding power of the support.

The charge generating layer 23 is constituted by containing a charge generating material and a binder resin. As the charge generating material, all the known materials, such as an azo pigment, e.g., a bisazo compound and a trisazo compound, a condensed ring aromatic pigment, such as dibromoanthanthrone, a perylene pigment, a pyrrolopyrrole pigment and a phthalocyanine pigment, can be used. A metallic or non-metallic phthalocyanine pigment is preferred, and among these hydroxygallium phthalocyanine, Chlorogallium phthalocyanine dichlorotin phthalocyanine and titanyl phthalocyanine having particular crystal structures are particularly preferred. Chlorogallium phthalocyanine used in the invention can be produced, for example, in such a manner that chlorogallium phthalocyanine crystals produced by the method disclosed in JP-A-5-98181 are dry-pulverized mechanically in an automortar, a planetary mill, a vibration mill, a CF mill, a roller mill, a sand mill or a kneader, or after the dry pulverization, they are subjected to wet pulverization along with a solvent by using a ball mill, a mortar, a sand mill or a kneader. Examples of the solvent used in the foregoing treatment include an aromatic compound (such as toluene and chlorobenzene), an amide compound (such as dimethylformamide and N-methylpyrrolidone), an aliphatic alcohol (such as methanol, ethanol and butanol), an aliphatic polyvalent alcohol (such as ethylene glycol, glycerin and polyethylene glycol), an aromatic alcohol (such as benzyl alcohol and phenethyl alcohol), an ester (such as ethyl acetate and butyl acetate), a ketone (such as acetone and methyl ethyl ketone), dimethylsulfoxide, an ether (such as diethyl ether and tetrahydrofuran), mixtures of these solvents, and mixed systems of these organic solvents and water. The solvent is preferably used in an amount of from 1 to 200 parts by weight, and more preferably from 10 to 100 parts by weight, per 1 part by weight of chlorogallium phthalocyanine. The treating temperature is preferable from 0° C. to the boiling point of the solvent, and more preferable from 10 to 60° C. A grinding assistant, such as sodium chloride and Glauber's salt, may be used upon pulverization. The using amount of the grinding assistant is preferable from 0.5 to 20 times, and more preferable from 1 to 10 times, for the amount of the pigment. Dichlorotin phthalocyanine can be obtained in a manner that dichlorotin phthalocyanine crystals produced by the method disclosed in JP-A-5-140472 and JP-A-5-140473 are pulverized and subjected to a solvent treatment in the same manner as in the case of chlorogallium phthalocyanine.

Hydroxygallium phthalocyanine can be produced in the following manner. Chlorogallium phthalocyanine crystals produced by the methods disclosed in JP-A-5-263007 and JP-A-5-279591 are subjected to hydrolysis in an acidic or alkaline solution or acid pasting to synthesize hydroxygallium phthalocyanine crystals, and the resulting crystals are directly subjected to a solvent treatment, or in alternative, hydroxygallium phthalocyanine crystals obtained by synthesis are subjected to a wet pulverization treatment along with a solvent by using a ball mill, a mortar, a sand mill or a kneader, or subjected to a dry pulverization treatment without the use of a solvent and then to a solvent treatment. Examples of the solvent used in the foregoing treatments include an aromatic compound (such as toluene and chlorobenzene), an amide compound (such as dimethylformamide and N-methylpyrrolidone), an aliphatic alcohol (such as methanol, ethanol and butanol), an aliphatic polyvalent alcohol (such as ethylene glycol, glycerin and polyethylene glycol), an aromatic alcohol (such as benzyl alcohol and phenethyl alcohol), an ester (such as ethyl acetate and butyl acetate), a ketone (such as acetone and methyl ethyl ketone), dimethylsulfoxide, an ether (such as diethyl ether and tetrahydrofuran), mixtures of these solvents, and mixed systems of these organic solvents and water. The solvent is preferable used in an amount of from 1 to 200 parts by weight, and more preferable from 10 to 100 parts by weight, per 1 part by weight of hydroxygallium phthalocyanine. The treating temperature is preferably from 0 to 150° C., and more preferably from room temperature to 100° C.

A grinding assistant, such as sodium chloride and Glauber's salt, may be used upon pulverization. The using amount of the grinding assistant is preferable from 0.5 to 20 times, and more preferable from 1 to 10 times, for the amount of the pigment.

Oxytitanyl phthalocyanine can be produced in the following manner. Oxytitanium phthalocyanine crystals produced by the methods disclosed in JP-A-4-189873 and JP-A-5-43813 are subjected to acid pasting or salt milling with an inorganic salt by using a ball mill, a mortar, a sand mill or a kneader to form oxytitanyl phthalocyanine crystals having relatively low crystallinity with a peak at 27.2° in the X-ray diffraction spectrum, and the resulting crystals are directly subjected to a solvent treatment or a wet pulverization treatment along with a solvent by using a ball mill, a mortar, a sand mill or a kneader. As the acid used for acid pasting, sulfuric acid (preferably having a concentration of from 70 to 100%, and more preferably from 95 to 100%) is preferably used, and dissolution in sulfuric acid is preferably carried out at a temperature of from −20 to 100° C., and more preferably from 0 to 60° C. The amount of sulfuric acid is preferably 1 to 100 times, and more preferably from 3 to 50 times, the weight of the oxytitanyl phthalocyanine crystals. After the dissolution, water or a mixed solvent of water and an organic solvent is used in an arbitrary amount as a solvent for depositing oxytitanyl phthalocyanine crystals, and a mixed solvent of water and an alcohol solvent, such as methanol and ethanol, and a mixed solvent of water and an aromatic solvent, such as benzene and toluene, are particularly preferred. The temperature, at which the oxytitanyl phthalocyanine crystals are deposited, is not particularly limited, and it is preferred that the system is cooled, for example, with ice for preventing heat generation. The ratio of the oxytitanyl phthalocyanine crystals and the inorganic salt is preferable from 1/0.1 to 1/20 by weight, and more preferable from 1/0.5 to 1/5 by weight. Examples of the solvent used in the foregoing treatment include an aromatic compound (such as toluene and chlorobenzene), an aliphatic alcohol (such as methanol, ethanol and butanol), a halogenated hydrocarbon (such as dichloromethane, chloroform and trichloroethane), mixtures of these solvents, and mixed systems of these organic solvents and water. The solvent is preferably used in an amount of from 1 to 100 parts by weight, and more preferably from 5 to 50 parts by weight, per 1 part by weight of oxytitanyl phthalocyanine. The temperature for the solvent treatment is preferable from room temperature to 100° C., and more preferable from 50 to 100° C. The using amount of the grinding assistant is preferable from 0.5 to 20 times, and more preferably from 1 to 10 times, for the amount of the pigment.

The binder resin used in the charge generating layer 23 can be selected from wide variations of electrically insulating resins and can also be selected from an organic photoelectroconductive polymer, such as poly-N-vinylcarbazole, polyvinylanthracene, polyvinylpyrene and polysilane. Preferred examples of the binder resin include an insulating resin, such as a polyvinyl butyral resin, a polyarylate resin (such as a polycondensate of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin and a polyvinylpyrrolidone resin, but it is not limited to these. The binder resins may be used solely or as a mixture of two or more kinds of them.

The mixing ratio of the charge generating material and the binder resin is preferable in a range of from 10/1 to 1/10 by weight. As the method for dispersing them, an ordinary method, such as a ball mill dispersing method, an attritor dispersing method and a sand mill dispersing method, can be used. Upon dispersion, conditions that the crystalline form of the crystals is not changed by the dispersing operation are necessary. Furthermore, it is effective upon dispersing that particles having an average particle diameter of 0.5 μm or less, more preferably 0.3 μm or less, and further preferably 0.15 μm or less, are used. As the solvent used on the dispersing operation, an ordinary organic solvent may be used singly or as a mixture of two or more kinds thereof, and examples of the organic solvent include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene.

The thickness of the charge generating layer 23 is preferable from 0.1 to 5 μm, and more preferably from 0.2 to 2.0 μm. Examples of the coating method for providing the charge generating layer include a blade coating method, a Mayer-bar coating method, a spray coating method, a dip coating method, a bead coating method, an air knife coating method and a curtain coating method. In order to improve the dispersion stability and the photosensitivity of the pigment or to stabilize the electric characteristics thereof, a charge generating material having been treated by using the compound represented by the following general formula (1) may be used, or in alternative, the compound may be added to a dispersion composition of the charge generating material.

The charge transporting layer 24 is constituted by containing a charge transporting material. In the case where the charge transporting material is a low molecular weight compound, the charge transporting material is generally dispersed in a binder resin and maintained in the layer, and in the case where a polymer charge transporting material is used, the binder resin may not be used.

Examples of the charge transporting material include an electron transporting compound, such as a quinone compound, e.g., p-benzoquinone, chloranil, bromanil and anthraquinone, a tetracyanoquinodimethane compound, a fluorenone compound, e.g., 2,4,7-trinitrofluorenone, a xanthone compound, a benzophenone compound, a cyanovinyl compound and an ethylene compound, and a positive hole transporting compound, such as a triarylamine compound, a benzidine compound, an arylalkane compound, an aryl-substituted ethylene compound, a stilbene compound, an anthracene compound and a hydrazone compound, and these compounds may be used solely or as a mixture of two or more of them. Among the charge transporting materials, a triphenylamine compound represented by the following general formula (2) and a benzidine compound represented by the following general formula (3) are particularly preferably used owing to the high charge (positive hole) transporting capability and the excellent stability thereof. Preferred examples of the combination of groups represented by $R^{14}$, $Ar^6$ and $Ar^7$ in the general formula (1) are shown in Tables 1 and 2, and preferred examples of the combination of groups represented by $R^{15}$, $R^{15'}$, $R^{16}$, $R^{16'}$, $R^{17}$ and $R^{17'}$ are shown in Table 3.

(1)

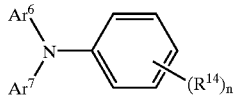

wherein $R^{14}$ represents a hydrogen atom or a methyl group; n represents 1 or 2; and $Ar^6$ and $Ar^7$, which may be the same as or different from each other, each represents a substituted or unsubstituted aryl group, in which when the aryl group has a substituent, the substituent is selected from a halogen atom, an alkyl group having from 1 to 5 carbon atoms, an alkoxy group having from 1 to 5 carbon atoms or a substituted amino group substituted with an alkyl group having from 1 to 3 carbon atoms.

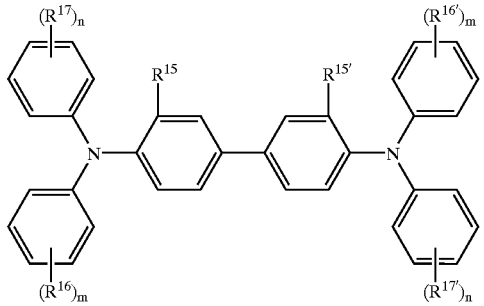

wherein $R^{15}$ and $R^{15'}$, which may be the same as or different from each other, each represents a hydrogen atom, a halogen atom, an alkyl group having from 1 to 5 carbon atoms or an alkoxy group having from 1 to 5 carbon atoms; $R^{16}$, $R^{16'}$, $R^{17}$ and $R^{17'}$, which may be the same as or different from each other, each represents a hydrogen atom, a halogen atom, an alkyl group having from 1 to 5 carbon atoms, an alkoxy group having from 1 to 5 carbon atoms or an amino group substituted with an alkyl group having from 1 to 3 carbon atoms; and m and n each represents an integer of from 0 to 2.

TABLE 1

| Compound No. | $R^{14}$ | $Ar^6$ | $Ar^7$ |
|---|---|---|---|
| V-1 | 4-$CH_3$ | 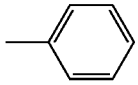 | 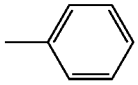 |
| V-2 | 3,4-$CH_3$ | | |
| V-3 | 4-$CH_3$ | 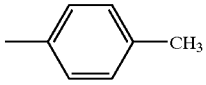 | 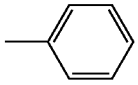 |
| V-4 | 3,4-$CH_3$ | | |
| V-5 | 4-$CH_3$ | 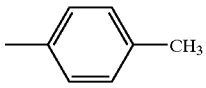 | 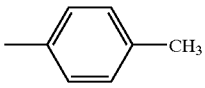 |
| V-6 | 3,4-$CH_3$ | | |
| V-7 | 4-$CH_3$ | 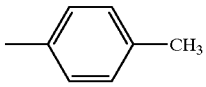 | 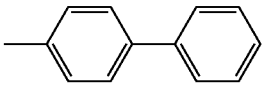 |
| V-8 | 3,4-$CH_3$ | | |
| V-9 | 4-$CH_3$ | 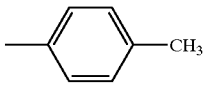 | 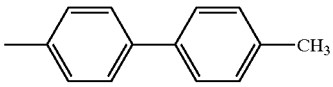 |
| V-10 | 3,4-$CH_3$ | | |
| V-11 | 4-$CH_3$ | 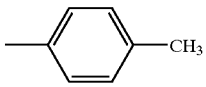 | 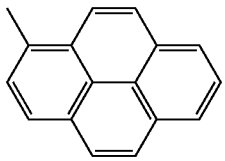 |
| V-12 | 3,4-$CH_3$ | | |
| V-13 | 4-$CH_3$ | 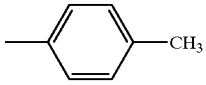 | 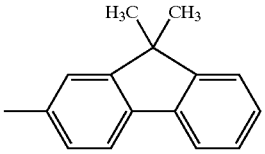 |
| V-14 | 3,4-$CH_3$ | | |

TABLE 1-continued
| Compound No. | $R^{14}$ | $Ar^6$ | $Ar^7$ |
|---|---|---|---|
| V-15<br>V-16 | 4-$CH_3$<br>3,4-$CH_3$ | 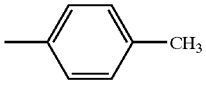 | 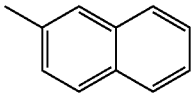 |
| V-17<br>V-18 | 4-$CH_3$<br>3,4-$CH_3$ | 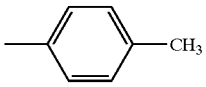 | 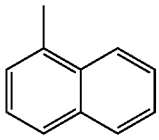 |
| V-19<br>V-20 | 4-$CH_3$<br>3,4-$CH_3$ | 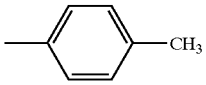 | 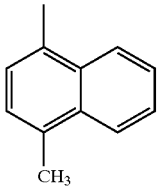 |
| V-21<br>V-22 | 4-$CH_3$<br>3,4-$CH_3$ | 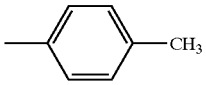 | 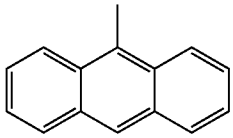 |
| V-23<br>V-24 | 4-$CH_3$<br>3,4-$CH_3$ | 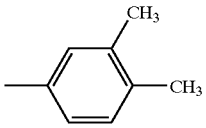 | 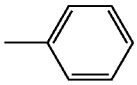 |
| V-25<br>V-26 | 4-$CH_3$<br>3,4-$CH_3$ | 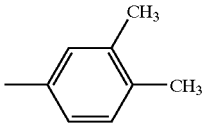 | 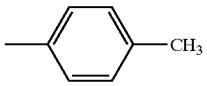 |
| V-27<br>V-28 | 4-$CH_3$<br>3,4-$CH_3$ | 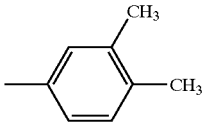 | 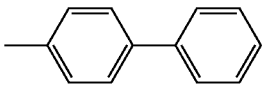 |
| V-29<br>V-30 | 4-$CH_3$<br>3,4-$CH_3$ | 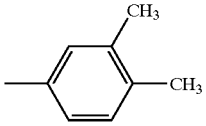 | 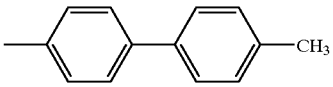 |
| V-31<br>V-32 | 4-$CH_3$<br>3,4-$CH_3$ | 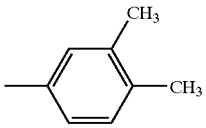 | 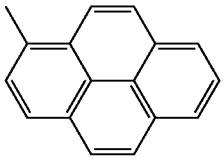 |
| V-33<br>V-34 | 4-$CH_3$<br>3,4-$CH_3$ | 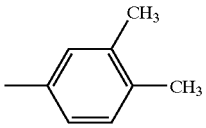 | 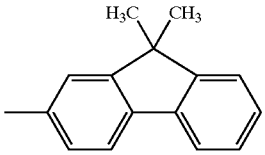 |

TABLE 1-continued
| Compound No. | $R^{14}$ | $Ar^6$ | $Ar^7$ |
|---|---|---|---|
| V-35<br>V-36 | 4-$CH_3$<br>3,4-$CH_3$ | 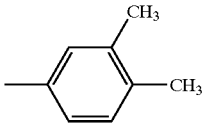 | 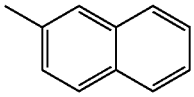 |
| V-37<br>V-38 | 4-$CH_3$<br>3,4-$CH_3$ | 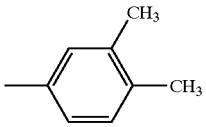 | 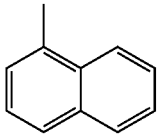 |
| V-39<br>V-40 | 4-$CH_3$<br>3,4-$CH_3$ | 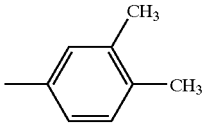 | 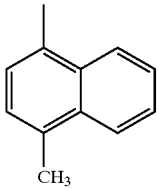 |
| V-41<br>V-42 | 4-$CH_3$<br>3,4-$CH_3$ | 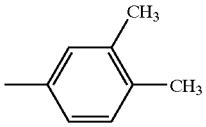 | 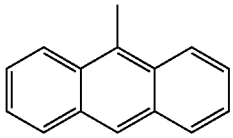 |
| V-43<br>V-44 | 4-$CH_3$<br>3,4-$CH_3$ | 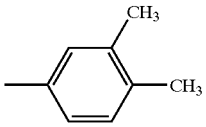 | 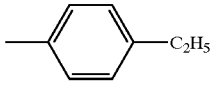 |
TABLE 2
| Compound No | $R^{14}$ | $Ar^6$ | $Ar^7$ |
|---|---|---|---|
| V-45<br>V-46 | 4-$CH_3$<br>3,4-$CH_3$ | 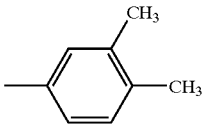 | 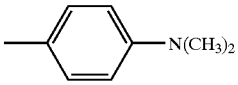 |
| V-47<br>V-48 | 4-$CH_3$<br>3,4-$CH_3$ | 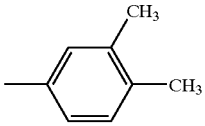 | 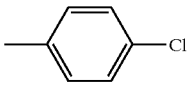 |
| V-49<br>V-50 | 4-$CH_3$<br>3,4-$CH_3$ | 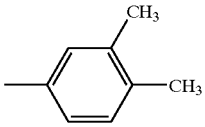 | 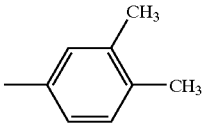 |
| V-51<br>V-52 | 4-$CH_3$<br>3,4-$CH_3$ | 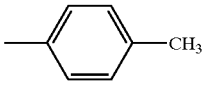 | 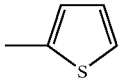 |

TABLE 2-continued

| Compound No | $R^{14}$ | $Ar^6$ | $Ar^7$ |
|---|---|---|---|
| V-53<br>V-54 | 4-$CH_3$<br>3,4-$CH_3$ | 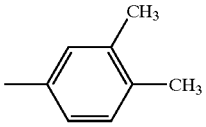 | 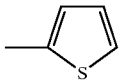 |
| V-55<br>V-56 | 4-$CH_3$<br>3,4-$CH_3$ | 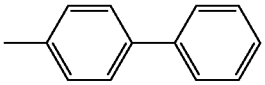 | 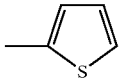 |
| V-57<br>V-58 | 4-$CH_3$<br>3,4-$CH_3$ | 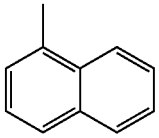 | 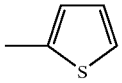 |
| V-59<br>V-60 | 4-$CH_3$<br>3,4-$CH_3$ | 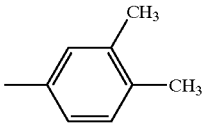 | 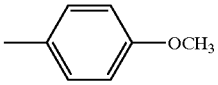 |
| V-61<br>V-62 | 4-$CH_3$<br>3,4-$CH_3$ | 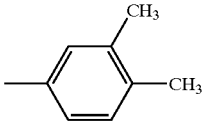 | 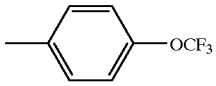 |

TABLE 3

| Compound No. | $R^{15}$, $R^{15'}$ | $(R^{16})_m$, $(R^{16'})_m$ | $(R^{17})_n$, $(R^{17'})_n$ |
|---|---|---|---|
| VI-1 | $CH_3$ | H | H |
| VI-2 | $CH_3$ | 2-$CH_3$ | H |
| VI-3 | $CH_3$ | 3-$CH_3$ | H |
| VI-4 | $CH_3$ | 4-$CH_3$ | H |
| VI-5 | $CH_3$ | 4-$CH_3$ | 2-$CH_3$ |
| VI-6 | $CH_3$ | 4-$CH_3$ | 3-$CH_3$ |
| VI-7 | $CH_3$ | 4-$CH_3$ | 4-$CH_3$ |
| VI-8 | $CH_3$ | 3,4-$CH_3$ | H |
| VI-9 | $CH_3$ | 3,4-$CH_3$ | 3,4-$CH_3$ |
| VI-10 | $CH_3$ | 4-$C_2H_5$ | H |
| VI-11 | $CH_3$ | 4-$C_3H_7$ | H |
| VI-12 | $CH_3$ | 4-$C_4H_9$ | H |
| VI-13 | $CH_3$ | 4-$C_2H_5$ | 2-$CH_3$ |
| VI-14 | $CH_3$ | 4-$C_2H_5$ | 3-$CH_3$ |
| VI-15 | $CH_3$ | 4-$C_2H_5$ | 4-$CH_3$ |
| VI-16 | $CH_3$ | 4-$C_2H_5$ | 3,4-$CH_3$ |
| VI-17 | $CH_3$ | 4-$C_3H_7$ | 3-$CH_3$ |
| VI-18 | $CH_3$ | 4-$C_3H_7$ | 4-$CH_3$ |
| VI-19 | $CH_3$ | 4-$C_4H_9$ | 3-$CH_3$ |
| VI-20 | $CH_3$ | 4-$C_4H_9$ | 4-$CH_3$ |
| VI-21 | $CH_3$ | 4-$C_2H_5$ | 4-$C_2H_5$ |
| VI-22 | $CH_3$ | 4-$C_2H_5$ | 4-$OCH_3$ |
| VI-23 | $CH_3$ | 4-$C_3H_7$ | 4-$C_3H_7$ |
| VI-24 | $CH_3$ | 4-$C_3H_7$ | 4-$OCH_3$ |
| VI-25 | $CH_3$ | 4-$C_4H_9$ | 4-$C_4H_9$ |
| VI-26 | $CH_3$ | 4-$C_4H_9$ | 4-$OCH_3$ |
| VI-27 | H | 3-$CH_3$ | H |
| VI-28 | Cl | H | H |
| VI-29 | Cl | 2-$CH_3$ | H |
| VI-30 | Cl | 3-$CH_3$ | H |
| VI-31 | Cl | 4-$CH_3$ | H |
| VI-32 | Cl | 4-$CH_3$ | 2-$CH_3$ |
| VI-33 | Cl | 4-$CH_3$ | 3-$CH_3$ |
| VI-34 | Cl | 4-$CH_3$ | 4-$CH_3$ |

TABLE 3-continued

| Compound No. | $R^{15}$, $R^{15'}$ | $(R^{16})_m$, $(R^{16'})_m$ | $(R^{17})_n$, $(R^{17'})_n$ |
|---|---|---|---|
| VI-35 | $C_2H_5$ | H | H |
| VI-36 | $C_2H_5$ | 2-$CH_3$ | H |
| VI-37 | $C_2H_5$ | 3-$CH_3$ | H |
| VI-38 | $C_2H_5$ | 4-$CH_3$ | H |
| VI-39 | $C_2H_5$ | 4-$CH_3$ | 4-$CH_3$ |
| VI-40 | $C_2H_5$ | 4-$C_2H_5$ | 4-$CH_3$ |
| VI-41 | $C_2H_5$ | 4-$C_3H_7$ | 4-$CH_3$ |
| VI-42 | $C_2H_5$ | 4-$C_4H_9$ | 4-$CH_3$ |
| VI-43 | $OCH_3$ | H | H |
| VI-44 | $OCH_3$ | 2-$CH_3$ | H |
| VI-45 | $OCH_3$ | 3-$CH_3$ | H |
| VI-46 | $OCH_3$ | 4-$CH_3$ | H |
| VI-47 | $OCH_3$ | 4-$CH_3$ | 4-$CH_3$ |
| VI-48 | $OCH_3$ | 4-$C_2H_5$ | 4-$CH_3$ |
| VI-49 | $OCH_3$ | 4-$C_3H_7$ | 4-$CH_3$ |
| VI-50 | $OCH_3$ | 4-$C_4H_9$ | 4-$CH_3$ |
| VI-51 | $CH_3$ | 2-$N(CH_3)_2$ | H |
| VI-52 | $CH_3$ | 3-$N(CH_3)_2$ | H |
| VI-53 | $CH_3$ | 4-$N(CH_3)_2$ | H |
| VI-54 | $CH_3$ | 4-Cl | H |

The binder resin, in which the charge transporting material is dispersed, is not particularly limited, and specific examples thereof include a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin and a styrene-alkyd resin.

In the invention, a polymer charge transporting material may be used as the charge transporting material as described in the foregoing. Examples of the polymer charge transporting material include known compounds having charge transporting property, such as poly-N-vinylcarbazole and polysilane. In particular, the polyester polymer charge transporting materials disclosed in JP-A-8-176293 and JP-A-8-208820 are particularly preferred because they have high charge transporting property. The polymer charge transporting material can be formed into a film by itself, and may be mixed with a binder resin and then formed into a film.

The mixing ratio of the charge transporting material and the binder resin is preferable from 10/1 to 1/5 by weight. The charge transporting layer 24 preferably has a thickness of from 5 to 50 $\mu$m, and more preferably from 10 to 30 $\mu$m. As the coating method for providing the charge transporting layer 24, an ordinary method, such as a blade coating method, a Mayer-bar coating method, a spray coating method, a dip coating method, a bead coating method, an air knife coating method and a curtain coating method, can be used. Examples of the solvent used in the coating step include ordinary organic solvents, such as an aromatic hydrocarbon, e.g., benzene, toluene, xylene and chlorobenzene, a ketone, e.g., acetone and 2-butabone, a halogenated aliphatic hydrocarbon, e.g., methylene chloride, chloroform and ethylene chloride, and a cyclic or linear ether, e.g., tetrahydrofuran and ethyl ether, which may be used singly or as a mixture of two or more of them.

While the charge transporting layer 24 may be constituted only with the charge transporting layer and the binder resin, various kinds of additives may be added thereto depending on necessity. Examples of the additive include an organic zirconium compound, such as a zirconium chelate compound, a zirconium alkoxide compound and a zirconium coupling agent, an organic titanium compound, such as a titanium chelate compound, a titanium alkoxide compound, a titanate coupling agent, and an organic aluminum compound, such as an aluminum chelate compound and an aluminum coupling agent, and an organic metallic compound, such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound and an aluminum zirconium alkoxide compound. Among these, an organic zirconium compound, an organic titanyl compound and an organic aluminum compound are preferably used since they have a low residual potential to exhibit good electrophotographic characteristics.

A silane coupling agent, such as vinyltrichlorosilane, vinyltrimethoxysilane, vinyltriethoxysilane, vinyl-tris-2-methoxyethoxysilane, vinyltriacetoxysilane, γ-glycidoxypropyltrimethoxysilane, γ-methacryloxypropyltrimethoxysilane, γ-aminopropyltrimethoxysilane, γ-chloropropyltrimethoxysilane, γ-2-aminoethylpropyltrimethoxysilane, γ-mercaptopropyltrimethoxysilane, γ-ureidopropyltriethoxysilane and β-3,4-epoxycyclohexyltrimethoxysilane, and a curable matrix, such as photo-curing resin, may be used as the additive for the charge transporting layer 24, and a curable compound (such as the compound represented by the following general formula (3)) may be further used in combination with these compounds.

An additive, such as an antioxidant, a photo-stabilizer and a thermal stabilizer, may be added to the photosensitive layer in order to prevent deterioration of the photoreceptor due to an oxidizing gas, such as ozone, light and heat generated during the image formation process. Examples of the antioxidant include a hindered phenol, a hindered amine, a paraphenylene diamine, arylalkane, hydroquinone, spirochromane, spiroindanone, derivatives thereof, an organic sulfur compound and an organic phosphorous compound. Examples of the photo-stabilizer include derivatives of benzophenone, benzotriazole, dithiocarbamate and tetramethylpiperidine. Furthermore, at least one kind of an electron acceptive compound may be added in order to improve the sensitivity and to lower the residual potential and the fatigue upon repeated use. Examples of the electron acceptive compound include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid and the compound represented by the general formula (1). Among these, a fluorenone compound, a quinone compound and a benzene compound that has an electron withdrawing group, such as —Cl, —CN and —$NO_2$, are particularly preferred.

The protective layer 25 is constituted by containing a crosslinked material having a skeleton that contains an organic group having charge transporting property, a silicon atom bonded to the same or different carbon atom in the organic group, and an oxygen atom bonded to the silicon atom, as described in the foregoing. Specific examples of the organic group having charge transporting property include an organic group having such a structure as a triarylamine structure, a benzidine structure, an arylalkane structure, an aryl-substituted ethylene structure, a stilbene structure, an anthraquinone structure, a hydrazone structure, a quinone structure, a fluorenone structure, a xanthone structure, a benzophenone structure, a cyanovinyl structure and an ethylene structure. The crosslinked material is imparted with charge transporting property by the presence of the organic group.

As the crosslinked material, a crosslinked material obtained by using a polymerizable monomer containing a compound represented by the following general formula (3) is preferably used.

(3)

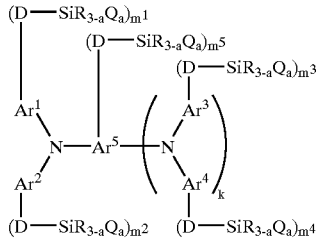

wherein $Ar^1$, $Ar^2$, $Ar^3$ and $Ar^4$, which may be the same as or different from each other, each represents a substituted or unsubstituted aryl group; $Ar^5$ represents a substituted or unsubstituted divalent aryl or arylene group; D represents a divalent group; Q represents a hydrolyzable group; a represents an integer of from 1 to 3; k represents 0 or 1; and $m^1$, $m^2$, $m^3$, $m^4$ and $m^5$, which may be the same as or different from each other, each represents 0 or 1, provided that at least one of $m^1$ to $m^5$ is 1, and when k is 1, $m^5$ is 0.

As the substituted or unsubstituted aryl group represented by $Ar^1$, $Ar^2$, $Ar^3$ and $Ar^4$ in the general formula (3), those having one of structures represented by the following general formulae (4) to (10).

(4)

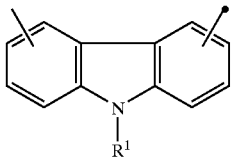

(5)

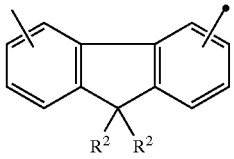

(6)

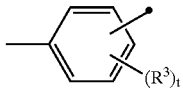

(7)

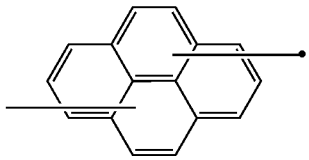

(8)

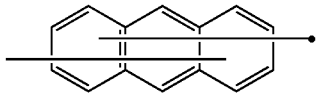

(9)

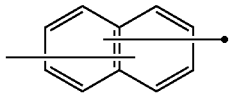

$$—Ar^6—(Z)_s—Ar^6— \quad (10)$$

wherein $R^1$ represents a hydrogen atom, an alkyl group having from 1 to 4 carbon atoms, a phenyl group, an alkylphenyl group having from 7 to 10 carbon atoms, an alkoxyphenyl group having from 7 to 10 carbon atoms or an aralkyl group having from 7 to 10 carbon atoms; $R^2$ and $R^3$ each represents a hydrogen atom, an alkyl group having from 1 to 4 carbon atoms, an alkoxy group having from 1 to 4 carbon atoms, a phenyl group, an alkoxyphenyl group having from 7 to 10 carbon atoms, an aralkyl group having from 7 to 10 carbon atoms or a halogen atom; $Ar^6$ represents a substituted or unsubstituted divalent aromatic hydrocarbon group; Z represents a divalent functional group; s represents an integer of from 1 to 3; and (black dot) represents a position at which the group represented by $-D-SiR_{3-a}Q_a$ in the general formula (3) is bonded.

As the substituted or unsubstituted divalent aromatic hydrocarbon group represented by $Ar^6$ in the general formula (10), a group represented by the following general formulae (11) and (12) are preferred.

(11)

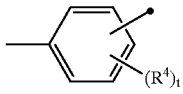

-continued (12)

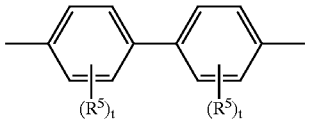

wherein $R^4$ and $R^5$ each represents a hydrogen atom, an alkyl group having from 1 to 4 carbon atoms, an alkoxy group having from 1 to 4 carbon atoms, a phenyl group, an alkoxyphenyl group having from 7 to 10 carbon atoms, an aralkyl group having from 7 to 10 carbon atoms or a halogen atom; and t represents an integer of from 1 to 3.

As the divalent group represented by Z in the general formula (10), those having one of structures represented by the following general formulae (13) to (20) are preferred.

$$—(CH_2)_q— \quad (13)$$

$$—(CH_2CH_2O)_r— \quad (14)$$

(15)

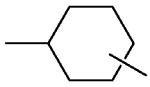

(16)

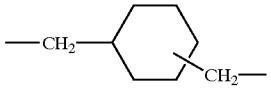

(17)

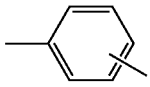

(18)

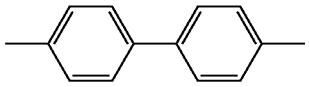

(19)

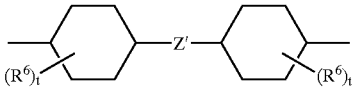

(20)

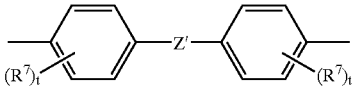

wherein $R^6$ and $R^7$ each represents a hydrogen atom, an alkyl group having from 1 to 4 carbon atoms, an alkoxy group having from 1 to 4 carbon atoms, a phenyl group, an alkoxyphenyl group having from 7 to 10 carbon atoms, an aralkyl group having from 7 to 10 carbon atoms or a halogen atom; Z' represents a divalent group; q and r each represents an integer of from 1 to 10; and t represents an integer of from 1 to 3.

As the divalent group represented by Z' in the general formulae (19) and (20), those having one of structures represented by the following general formulae (21) to (29) are preferred.

$$-CH_2- \quad (21)$$

(22)

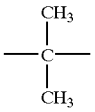

$$-O- \quad (23)$$

$$-S- \quad (24)$$

(25)

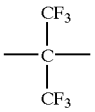

(26)

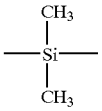

(27)

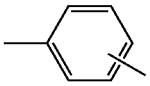

(28)

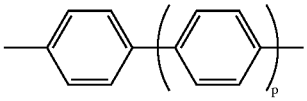

(29)

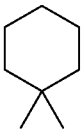

wherein p represents an integer of from 0 to 3.

$Ar^5$ in the general formula (3) represents an aryl group exemplified for $Ar^1$ to $Ar^4$ when k is 0, and represents an arylene group obtained by removing a hydrogen atom from the aryl group when k is 1.

The divalent group represented by D in the general formula (3) is preferably divalent hydrocarbon groups represented by $-C_nH_{2n}-$, $-C_nH_{2n-2}-$, $-C_nH_{2n-4}-$ (wherein n represents an integer of from 1 to 15, and preferably an integer of from 2 to 10), $-CH_2-C_6H_4-$ or $-C_6H_4-C_6H_4-$, an oxycarbonyl group (—COO—), a thio group (—S—), an oxy group (—O—), an isocyano group (—N═CH—) or a divalent group obtained by combining two or more kinds of these groups. These divalent groups may have a substituent, such as an alkyl group, a phenyl group, an alkoxy group and an amino group, on the side chain thereof. In the case where D is the foregoing preferred divalent group, the polyfunctional photofunctional fluorine-containing organic silicate skeleton is imparted with moderate flexibility to provide such a tendency that the strength of the layer is improved.

R in the general formula (3) represents, as described in the foregoing, a hydrogen atom, an alkyl group (preferably an alkyl group having from 1 to 5 carbon atoms) or a substituted or unsubstituted aryl group (preferably a substituted or unsubstituted aryl group having from 6 to 15 carbon atoms).

The hydrolyzable represented by Q in the general formula (3) is a functional group that can form a siloxane bond (O—Si—O) through hydrolysis in the curing reaction of the compound represented by the general formula (1). Preferred examples of the hydrolyzable group in the invention include a hydroxyl group, an alkoxy group, a methyl ethyl ketoxime group, a diethylamino group, an acetoxy group, a propenoxy group and a chloro group, and among these, a group represented by —OR" (wherein R" represents an alkyl group having from 1 to 15 carbon atoms or a trimethylsilyl group) is more preferred.

Preferred examples of the combination of the groups represented by $Ar^1$, $Ar^2$, $Ar^3$, $Ar^4$, $Ar^5$ and $D\text{-}SiR_{3-a}Q_a$ and the integer represented by k are shown in Tables 4 to 6. In the tables, X represents $D\text{-}SiR_{3-a}Q_a$ bonded to $Ar^1$ to $Ar^5$, Me represents a methyl group, Et represents an ethyl group, and Pr represents a propyl group.

TABLE 4
| Compound | k | $Ar^1$ | $Ar^2$ | $Ar^3$ | $Ar^4$ | $Ar^5$ | X |
|---|---|---|---|---|---|---|---|
| 1 | 0 | 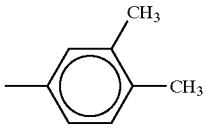 | 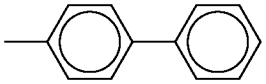 | — | — | 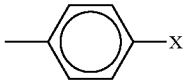 | —$(CH_2)_2COO$— —$(CH_2)_3Si(OMe)_3$ |
| 2 | 1 | 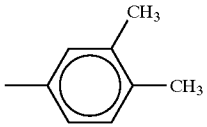 | 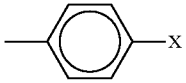 | 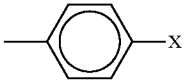 | 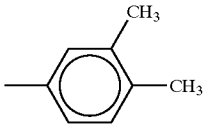 | 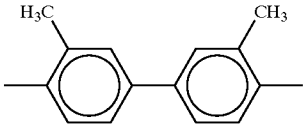 | —$(CH_2)_2Si(OEt)_3$ |
| 3 | 1 | 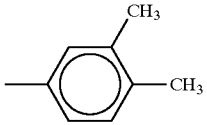 | 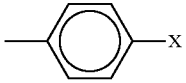 | 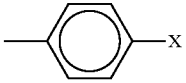 | 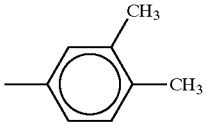 | 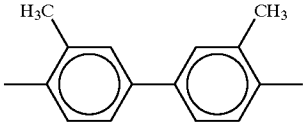 | —CH═CH$(CH_2)_2$— —$Si(OEt)_3$ |
| 4 | 1 | 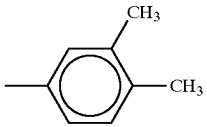 | 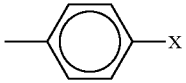 | 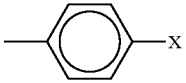 | 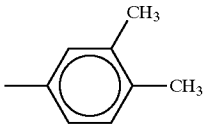 | 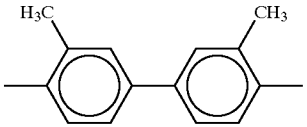 | —$(CH_2)_2COO$— —$(CH_2)_3Si(OMe)_3$ |
| 5 | 0 | 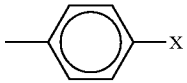 | 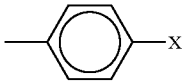 | — | — | 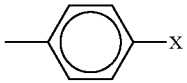 | —$(CH_2)_3$— —$SiMe(OMe)_2$ |

TABLE 5
| Compound | k | $Ar^1$ | $Ar^2$ | $Ar^3$ | $Ar^4$ | $Ar^5$ | X |
|---|---|---|---|---|---|---|---|
| 6 | 0 | 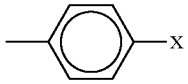 | 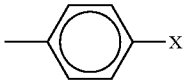 | — | — | 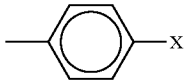 | —CH=N$(CH_2)_3$— —Si$(OMe)_3$ |
| 7 | 0 | 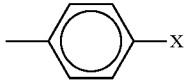 | 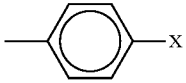 | — | — | 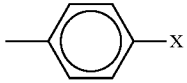 | —$(CH_2)_3O(CH_2)_3$— —Si$Me(OMe)_2$ |
| 8 | 1 | 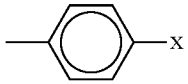 | 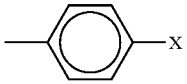 | 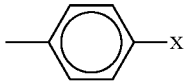 | 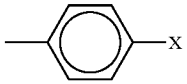 | 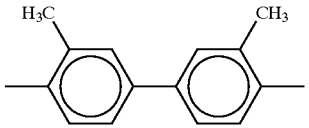 | —$(CH_2)_3O(CH_2)_3$— —Si$(OMe)_3$ |
| 9 | 0 | 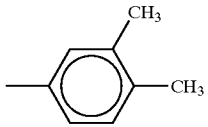 | 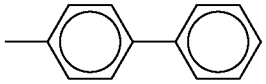 | — | — | 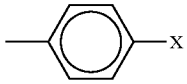 | —$COOCH_2C_6H_4$— —$(CH_2)_2$— —Si$(O\text{-}i\text{-}Pr)_3$ |
| 10 | 1 | 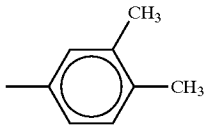 | 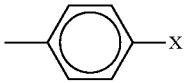 | 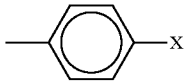 | 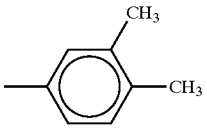 | 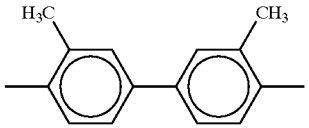 | —$(CH_2)_2COO$— —$(CH_2)_3$— —Si$(O\text{-}i\text{-}Pr)_3$ |

TABLE 6

| Compound | k | $Ar^1$ | $Ar^2$ | $Ar^3$ |
|---|---|---|---|---|
| 11 | 1 | 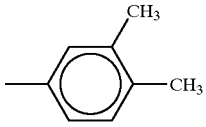 | 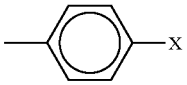 | 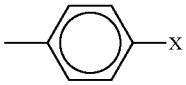 |
| 12 | 0 | 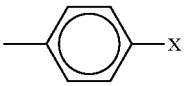 | 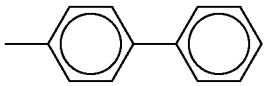 | — |
| 13 | 0 | 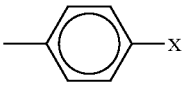 | 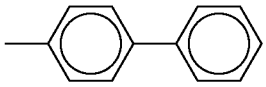 | — |
| 14 | 0 | 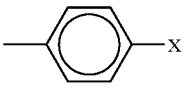 | 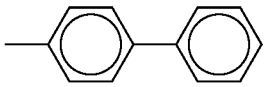 | — |
| **Compound** | **k** | **$Ar^4$** | **$Ar^5$** | **X** |
| 11 | 1 | 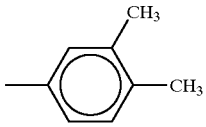 | 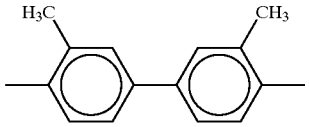 | —COO(CH$_2$)$_2$—<br>—(CH$_2$)$_3$—<br>—SiMe(O-i-Pr)$_2$ |
| 12 | 0 | — | 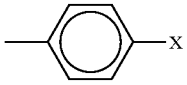 | —COO(CH$_2$)$_2$—<br>—(CH$_2$)$_3$—<br>—SiMe(O-i-Pr)$_2$ |
| 13 | 0 | — | 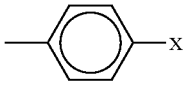 | —(CH$_2$)$_2$COO—<br>—(CH$_2$)$_3$—<br>—SiMe(O-i-Pr)$_2$ |
| 14 | 0 | — | 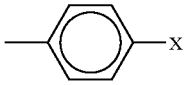 | —(CH$_2$)$_2$COO—<br>—(CH$_2$)$_3$—<br>—Si(O-i-Pr)$_3$ |

While the crosslinked material contained in the protective layer 25 may be a material obtained only with the compound represented by the general formula (3), other polymerizable monomers having a group capable of being bonded to the compound represented by the general formula (3) may further be used.

The group capable of being bonded to the compound represented by the general formula (3) herein means a group capable of being bonded to a silanol group formed upon hydrolysis of the compound represented by the general formula (3), and specific examples thereof include a group represented by —$SiR_{3-a}Q_a$, an epoxy group, an isocyanate group, a carboxyl group, a hydroxyl group and a halogen atom. Among these, a compound having a group represented by —$SiR_{3-a}Q_a$, an epoxy group or an isocyanate group are preferred since it provide large mechanical strength, and a compound having a group represented by —$SiR_{3-a}Q_a$ is particularly preferred. When a compound having a pair of these groups in the molecule is used, the cured film has a three-dimensional crosslinked structure to obtain larger mechanical strength. Preferred examples of the polymerizable monomer are shown in Table 7.

TABLE 7

| | | | |
|---|---|---|---|
| I-1 | 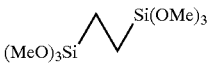 | I-2 | 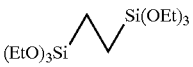 |
| I-3 | 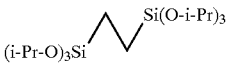 | I-4 | 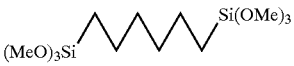 |
| I-5 | 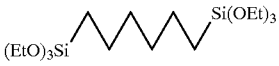 | I-6 | 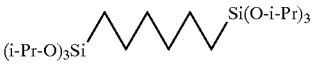 |

TABLE 7-continued

| | | | |
|---|---|---|---|
| I-7 | 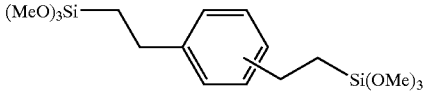 | I-8 | 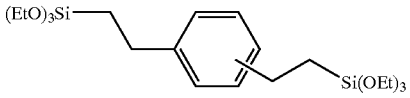 |
| I-9 | 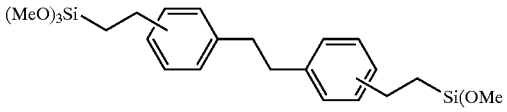 | I-10 | 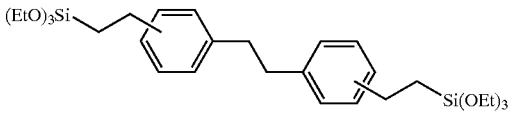 |
| I-11 | 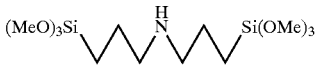 | I-12 | 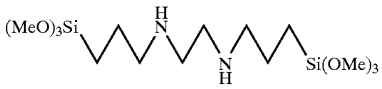 |
| I-13 | 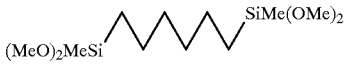 | I-14 | 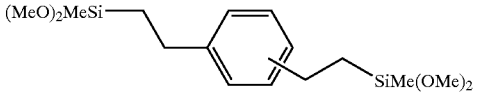 |
| I-15 | $(MeO)_3SiC_3H_6—O—CH_2CH\{—O—C_3H_6Si(OMe)_3\}—CH_2\{—O—C_3H_6Si(OMe)_3\}$ | | |

In addition to the foregoing polymerizable monomers, a silane coupling agent and a hardcoating agent may be used. Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, tetramethoxysilane, methyltrimethoxysilane and dimethyldimethoxysilane. Examples of the hardcoating agent include commercially available hardcoating agents, such as KP-85, X-40-9740 and X40-2239 (all produced by Shin-Etsu Silicone Co., Ltd.) and AY42-440, AY42-441 and AY49-208 (all produced by Toray Dow Corning Co., Ltd.). In order to impart water repellency, one kind or two or more kinds of a fluorine-containing compound, such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane and 1H,1H,2H,2H-perfluorooctyltriethoxysilane, may be used.

The crosslinked material in the invention can be obtained by hydrolyzing the foregoing polymerizable monomer. The addition amount of water in the hydrolysis reaction is not particularly limited, and it is preferably from 0.3 to 5 times, more preferable from 0.5 to 3 times, the theoretical amount that is necessary for hydrolyzing all the hydrolyzable groups in the polymerizable monomer. When the addition amount of water is less than 0.3 time or less the theoretical amount, the amount of the unreacted compound is increased to provide a tendency that in the production process of the electrophotographic photoreceptor described later, phase separation occurs upon film formation using a coating composition containing the crosslinked material, and the strength of the resulting film becomes insufficient. When the addition amount of water exceeds 5 times the theoretical amount, on the other hand, there is a tendency that the raw material compound is deposited, and the storage stability of the reaction product (crosslinked material) is lowered.

The hydrolysis reaction of the polymerizable monomer may be carried out by using no solvent, or may be carried out by using a prescribed solvent (preferably a solvent having a boiling point of 100° C. or less). Examples of the solvent used upon hydrolysis in the invention include an alcohol, such as methanol, ethanol, propanol and butanol; a ketone, such as acetone and methyl ethyl ketone; and an ether, such as tetrahydrofuran, diethyl ether and dioxane. The using amount of the solvent is preferable from 0.5 to 30 parts by weight, and more preferable from 1 to 20 parts by weight, per 1 part by weight of the compound represented by the general formula (3). When the using amount of the solvent is less than the lower limit, there is such a tendency that the compound represented by the general formula (3) is deposited, and when it exceeds the upper limit, on the other hand, there is such a tendency that only a thin film can be obtained.

It is preferred in the hydrolysis reaction to use a solid catalyst that is insoluble in all the raw material compound, the reaction product, the solvent and water.

Examples of the solid catalyst include:

a cation exchange resin, such as Amberlite 15E, Amberlite 200C and Amberlyst 15 (all produced by Rohm and Haas Corp.), Dowex MWC-1-H, Dowex 88 and Dowex HCR-W2 (all produced by Dow Chemical Inc.), Lewatit SPC-108 and Lewatit SPC-118 (all produced by Bayer AG), Diaion RCP-150H (all produced by Mitsubishi Kasei Corp.), Sumikaion KC-470, Duolite C26-C, Duolite C-433 and Duolite 464 (all produced by Sumitomo Chemical Co., Ltd.), and Nafion H (produced by Du Pont Company);

an anion exchange resin, such as Amberlite IRA-400 and Amberlite IRA-45 (all produced by Rohm and Haas Corp.);

an inorganic solid having a group containing a protonic acid group bonded on the surface thereof, such as $Zr(O_3PCH_2CH_2SO_3H)_2$ and $Th(O_3PCH_2CH_2COOH)_2$;

polyorganosiloxane containing a protonic acid group, such as polyorganosiloxane having a sulfonic acid group;

a heteropolyacid, such as cobalt tungstic acid and phosphorous molybdic acid;

an isopolyacid, such as niobic acid, tantalic acid and molybdic acid;

a monoelemental metallic oxide, such as silica gel, alumina, chromia, zirconia CaO and MgO;

a composite metallic oxide, such as silica-alumina, silica-magnesia, silica-zirconia and zeolite;

a clay mineral, such as acid clay, activated clay, montmorillonite and kaolinite;

a metallic sulfate, such as $LiSO_4$ and $MgSO_4$;

a metallic phosphate, such as zirconium phosphate and lanthanum phosphate;

a metallic nitrate, such as $LiNO_3$ and $Mn(NO_3)_2$;

an inorganic solid having a group containing an amino group bonded on the surface thereof, such as a solid obtained by reacting aminopropyltriethoxysilane on silica gel; and polyorganosiloxane containing an amino group, such as an amino-modified silicone resin.

The using amount of the solid catalyst is preferable from 0.1 to 20 parts by weight per 100 parts by weight of the raw material compound having a hydrolyzable group. While the reaction temperature and the reaction time upon carrying out the hydrolysis reaction by using the solid catalyst are appropriately selected depending on the kinds of the raw material compound and the solid catalyst, the reaction temperature is preferable from 0 to 100° C., more preferable from 10 to 70° C., and further preferably 15 to 50° C., and the reaction time is preferable from 10 minutes to 100 hours. When the reaction time exceeds 100 hours, there is a tendency that the reaction product is gelled.

In addition to the foregoing solid catalyst, the hydrolysis reaction may be carried out by using a curing catalyst, such as a protonic acid, such as hydrochloric acid, acetic acid, phosphoric acid and sulfuric acid; a base, such as ammonia and triethylamine; an organic tin compound, such as dibutyltin diacetate, dibutyltin dioctoate and stannous octoate; an organic titanium compound, such as tetra-n-butyl titanate and tetraisopropyl titanate; an organic aluminum compound, such as aluminum tributoxide and aluminum trisacetylacetonate; and an organic carboxylic acid salt, such as an iron salt, a manganese salt, a cobalt salt, a zinc salt and a zirconium salt of an organic carboxylic acid. Among these curing catalysts, a metallic compound is preferred from the standpoint of storage stability of the reaction product, and a metallic acetylacetonate and a metallic acetylacetate are more preferred. The using amount of the curing catalyst is preferable from 0.1 to 20 parts by weight, and more preferable 0.3 to 10 parts by weight, per 100 parts by weight of the raw material compound having a hydrolyzable group from the standpoint of storage stability and strength of the reaction product. While the reaction temperature and the reaction time upon carrying out the hydrolysis reaction by using the curing catalyst are appropriately selected depending on the kinds of the raw material compound and the curing catalyst, the reaction temperature is preferable 60° C. or more, and more preferable from 80 to 170° C., and the reaction time is preferable from 10 minutes to 5 hours. When the reaction temperature is lower than the lower limit, there is a tendency that the mechanical strength of the resulting crosslinked material becomes insufficient.

Furthermore, depending on necessity, the resulting reaction product may be subjected to a hydrophobic treatment by using hexamethyldisilazane or trimethylchlorositane.

It is preferred to add an antioxidant to the protective layer 25 in order to prevent deterioration due to an oxidizing gas, such as ozone in a charging device. When the mechanical strength of the surface of the photoreceptor is improved to prolong the service life of the photoreceptor, the photoreceptor is being in contact with an oxidizing gas for a long period of time, and therefore, higher oxidation resistance than the conventional products is necessary. A hindered phenol compound and a hindered amine compound are preferred as the antioxidant, and the known antioxidants may also be used, such as an organic sulfur antioxidant, a phosphite antioxidant, a dithiocarbamic acid antioxidant, a thiourea antioxidant and a benzimidazole antioxidant. The addition amount of the antioxidant is preferable 15% by weight or less, and more preferable 10% by weight or less.

Examples of the hindered phenol antioxidant include 2,6-di-t-butyl-4-methylphenol, 2,5-di-t-butylhydroquinone, N,N'-hexamethylenebis(3,5-di-t-butyl-4-hydroxyhydrocinnamide, 3,5-di-t-butyl-4-hydroxybenzylphosphonate diethyl ester, 2,4-bis((octyl)methyl)-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate and 4,4'-butylidenebis(3-methyl-6-t-butylphenol).

The dynamic hardness of the surface of the protective layer 25 itself is not particularly limited as far as the dynamic hardness of the surface of the total photoreceptor 1 satisfies the foregoing conditions, and it preferably satisfy the following conditions. That is, when the protective layer 25 and the intermediate transfer belt 9 are formed on glass supports, respectively, a value (b'-b) obtained by subtracting the dynamic hardness (b) of the surface of the protective layer 25 from the dynamic hardness (b') of the intermediate transfer belt 9 is $1.5\times10^{10}$ N/m$^2$ or less. When the dynamic hardness of the surface of the protective layer 25 satisfies the conditions, damages of the photoreceptor and the intermediate transfer body and occurrence nibbled images can be further certainly prevented.

Intermediate Transfer Body

The intermediate transfer belt 9 is a transfer medium, on which the color toner images of respective colors formed on the photoreceptors 1*a* to 1*d* are accumulated. The dynamic hardness of the surface thereof is set at a value that it is larger than the dynamic hardness of the surface of the photoreceptor 1, and the value obtained by subtracting the dynamic hardness of the surface of the photoreceptors 1 from the dynamic hardness of the surface of the intermediate transfer belt 9 is $2.0\times10^{10}$ N/m$^2$ or less. The dynamic hardness of the surface of the intermediate transfer belt 9 is preferably $1.8\times10^{10}$ N/m$^2$ or more since image defects, such as nibbled images, can be further certainly prevented.

The material for the intermediate transfer belt 9 is not particularly limited as far as the dynamic hardness of the surface thereof satisfies the foregoing conditions, and it is preferably a polyimide resin. When an intermediate transfer belt 9 formed with a polyimide resin having a high Young's modulus is used, deformation of the intermediate transfer belt 9 upon driving it due to stress caused by the rolls 6 to 8 supporting the belt and the cleaning blade 14 can be suppressed, whereby occurrence of image defects, such as color drift, upon accumulating the toner images of respective colors can be prevented.

The intermediate transfer belt 9 can be produced in the following manner. Substantially equimolar amounts of tetracarboxylic acid dianhydride or a derivative thereof and a diamine are subjected to a polymerization reaction in a prescribed solvent to form a polyamide acid solution. The polyamide acid solution is formed into a film (layer) by supplying to and spreading on a cylindrical mold, followed by subjecting to imide conversion, to obtain an intermediate transfer belt 9 formed with a polyimide resin.

Examples of the tetracarboxylic acid dianhydride include a compound represented by the following general formula (30).

(30)

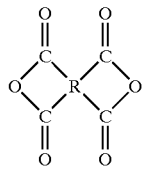

wherein R represents a tetravalent organic group selected from the group consisting of an aliphatic linear hydrocarbon group, an alicyclic hydrocarbon group, an aromatic hydrocarbon group and groups formed by bonding a substituent to the hydrocarbon groups. Specific examples thereof include pyromellitic acid dianhydride, 3,3',4,4'-benzophenonetetracarboxylic acid dianhydride, 3,3',4,4'-biphenyltetracarboxylic acid dianhydride, 2,3,3',4-biphenyltetracarboxylic acid dianhydride, 2,3,6,7-naphthalenetetracarboxylic acid dianhydride, 1,2,5,6-naphthalenetetracarboxylic acid dianhydride, 1,4,5,8-naphthalenetetracarboxylic acid dianhydride, 2,2'-bis(3,4-dicarboxyphenyl)sulfonic acid dianhydride, perylene-3,4,9,10-tetracarboxylic acid dianhydride, bis(3,4-dicarboxyphenyl)ether dianhydride and ethylenetetracarboxilic acid dianhydride.

Specific examples of the diamine include 4,4'-diaminodiphenyl ether, 4,4'-diaminodphenylmethane, 3,3'-diaminodiphenylmethane, 3,3'-dichlorobenzidine, 4,4'-diaminodiphenyl sulfide, 3,3'-diaminodiphenylsulfone, 1,5-diaminonaphthalene, m-phenylene diamine, p-phenylene diamine, 3,3'-dimethyl-4,4'-biphenyldiamine, benzidine, 3,3'-dimethylbenzidine, 3,3'-dimethoxybenzidine, 4,4'-diaminodiphenylsulfone, 4,4'-diaminodiphenylpropane, 2,4-bis(β-amino-t-butyl)toluene, bis(p-β-amino-t-butylphenyl) ether, bis(p-β-methyl-δ-aminophenyl)benzene, bis-p-(1,1-dimethyl-5-aminobenzyl)benzene, 1-isopropyl-2,4-m-phenylene diamine, m-xylylene diamine, p-xylylene diamine, di(p-aminocyclohexyl)methane, hexamethylene diamine, heptamethylene diamine, octamethylene diamine, nonamethylene diamine, decamethylene diamine, diaminopropyltetramethylene, 3-methylheptamethylene diamine, 4,4-dimethylheptamethylene diamine, 2,11-diaminododecane, 1,2-bis-3-aminopropoxyethane, 2,2-dimethylpropylene diamine, 3-methoxyhexamethylene diamine, 2,5-dimethylheptamethylene diamine, 3-methylheptamethylene diamine, 5-methylnonamethylene diamine, 2,17-diaminoeicosadecane, 1,4-diaminocyclohexane, 1,10-diamino-1,10-dimethyldecane, 12-diamonooctadecane, 2,2-bis(4-(4-aminophenoxy) phenyl)propane, piperazine, $H_2N(CH_2)_3O(CH_2)_2O(CH_2)NH_2$, $H_2N(CH_2)_3S(CH_2)_3NH_2$ and $H_2N(CH_2)_3N(CH_3)_2(CH_2)_3NH_2$.

A polar solvent is preferred as the solvent used in the polymerization reaction of the tetracarboxylic acid dianhydride and the diamine. As the polar solvent, N,N-dialkylamide compounds are preferred, and among these, those having a low molecular weight is more preferred, such as N,N-dimethylformamide, N,N-dimethylacetamide, N,N-diethylformamide, N,N-diethylacetamide, N,N-dimethylmethoxyacetamide, dimethysulfoxide, hexamethylphosphoryltriamide, N-methyl-2-pyrrolidone, pyridine, tetramethylenesulfone and dimethyltetramethylenesulfone. These may be used singly or in combination of two or more kinds of them.

In the invention, carbon may be dispersed in the polyimide resin in order to adjust the membrane resistance of the intermediate transfer belt 9. The kind of the carbon is not particularly limited, and it is preferred to use oxidized carbon black having formed on the surface thereof an oxygen-containing functional group (such as a carboxyl group, a quinone group, a lactone group and a hydroxyl group) through an oxidation treatment of carbon black. When the oxidized carbon black is dispersed in the polyimide resin, an excess electric current passes in the oxidized carbon black upon application of voltage, and therefore, the polyimide resin is difficult to suffer influence of oxidation due to repeated application of voltage. Furthermore, because the oxidized carbon black has good dispersibility in the polyimide resin owing to the oxygen-containing groups formed on the surface thereof, fluctuation in resistance can be suppressed, and the electric field dependency is also suppressed, whereby electric field concentration of the transfer electric field is difficult to occur. Therefore, such an intermediate transfer belt can be obtained that is prevented from resistance drop due to the transfer electric field, is improved in uniformity of electric field, has less dependency on the electric field, exhibits less fluctuation in resistance depending on environments, and is suppressed from occurrence of image defects, such as white dropouts in the paper running part.

The oxidized carbon black can be obtained, for example, by an air oxidization method, in which carbon black is made in contact with air under a high temperature atmosphere, a method, in which carbon black is reacted with a nitrogen oxide or ozone, and a method, in which carbon black is oxidized with air at a high temperature and then subjected to ozone oxidation at a low temperature. Commercially available products may also be used as the oxidized carbon black, such as MA100 (pH 3.5, volatile content: 1.5%), MA100R (pH 3.5, volatile content: 1.5%), MA100S (pH 3.5, volatile content: 1.5%), #970 (pH 3.5, volatile content: 3.0%), MA11 (pH3.5, volatile content: 2.0%), #1000 (pH 3.5, volatile content: 3.0%), #2200 (pH 3.5, volatile content: 3.5%), MA230 (pH 3.0, volatile content: 1.5%), MA220 (pH 3.0, volatile content: 1.0%), #2650 (pH 3.0, volatile content: 8.0%), MA7 (pH 3.0, volatile content: 3.0%), MA8 (pH 3.0, volatile content: 3.0%), OIL7B (pH 3.0, volatile content: 6.0%), MA77 (pH 2.5, volatile content: 3.0%), #2350 (pH 2.5, volatile content: 7.5%), #2700 (pH 2.5, volatile content: 10.0%) and #2400 (pH 2.5, volatile content: 9.0%), all produced by Mitsubishi Chemical Corp.; Printex 150T (pH 4.5, volatile content: 10.0%), Special Black 350 (pH 3.5, volatile content: 2.2%), Special Black 100 (pH 3.3, volatile content: 2.2%), Special Black 250 (pH 3.1, volatile content: 2.0%), Special Black 5 (pH 3.0, volatile content: 15.0%), Special Black 4 (pH 3.0, volatile content: 14.0%), Special Black 4A (pH 3.0, volatile content: 14.0%), Special Black 550 (pH 2.8, volatile content: 2.5%), Special Black 6 (pH 2.5, volatile content: 18.0%), Color Black FW200 (pH 2.5, volatile content: 20.0%), Color Black FW2 (pH 2.5, volatile content: 16.5%) and Color Black FW2V (pH 2.5, volatile content: 16.5%), all produced by Degussa AG; and MONARCH 1000 (pH 2.5, volatile content: 9.5%), MONARCH 1300 (pH 2.5, volatile content: 9.5%), MONARCH 1400 (pH 2.5, volatile content: 9.0%), MOGUL-L (pH 2.5, volatile content: 5.0%) and REGAL 400R (pH 4.0, volatile content: 3.5%), all produced by Cabot Corp.

The oxidized carbon black is different in electroconductivity depending on the physical properties, such as the extent of oxidation, the DBP oil absorption and the specific surface area measured by the BET method utilizing nitrogen adsorption. They may be used solely or in combination of two or more kinds thereof, and it is preferred use two or more kinds thereof having substantially different electroconductivity in combination. In the case where two or more kinds of carbon black having different physical properties are added, carbon black exerting high electroconductivity is firstly added, and then carbon black having low electroconductivity is added to adjust the surface resistivity.

The content of the oxidized carbon black is preferable from 10 to 50% by weight, and more preferable from 12 to 30% by weight, based on the amount of the polyimide resin. The content is less than 10% by weight, there are some cases where the uniformity of electric resistance is lowered, and the drop in surface resistivity upon endurance use is increased. When it exceeds 50% by weight, on the other hand, it is not preferred because a desired resistance value is difficult to be obtained, and the molded article becomes brittle.

Examples of the method for producing a polyamide acid solution having two or more kinds of oxidized carbon black dispersed therein include a method, in which the acid dianhydride component and the diamine component are dissolved in a dispersion having two or more kinds of oxidized carbon black dispersed therein, and then polymerized, and a method, in which two or more kinds of oxidized carbon black each is dispersed in solvents to form two or more kinds of carbon black dispersions, and the acid dianhydride component and the diamine component are dissolved in the dispersion and then polymerized, followed by mixing the resulting polyamide acid solutions.

The intermediate transfer body 9 is obtained in such a manner that the polyamide acid solution thus obtained is supplied to and spread on an inner surface of a cylindrical mold to form a film, and then subjected to imide conversion by heating. The imide conversion is carried out by maintaining the film at a prescribed temperature for 0.5 hour or more to obtain an intermediate transfer belt having good flatness.

Examples of the method for supplying the polyamide acid solution to the inner surface of the cylindrical mold include a method using a dispenser and a method using a dice. The cylindrical mold used herein preferably has an inner surface having been mirror finished.

Examples of the method for forming a film with the polyamide acid solution having been supplied to the mold include a method of centrifugal molding under heating, a method of molding by using a bullet running body, and a method of rotational molding, and a film having a uniform thickness can be obtained by these methods.

Examples of the method for forming the intermediate transfer belt by imide conversion of the film thus formed include (i) a method, in which the mold having the film formed thereon is put in a dryer, and the temperature is increased to the reaction temperature of the imide conversion, and (ii) a method, in which after removing the solvent from the film to such an extent that the film can maintain the belt shape, the film is released from the inner surface of the mold and then put on an outer surface of a metallic cylinder, and the cylinder having the film is heated to effect the imide conversion. In the invention, either the method (i) or (ii) may be carried out for the imide conversion as far as the dynamic hardness of the surface of the intermediate transfer belt satisfies the foregoing conditions, and the imide conversion is preferably carried out by the method (ii) because an intermediate transfer body having good flatness and good accuracy on the outer surface thereof can be efficiently obtained. The method (ii) will be described in detail below.

In the method (ii), while the heating conditions for removing the solvent are not particularly limited as far as the solvent can be removed, the heating temperature is preferable from 80 to 200° C., and the heating time is preferable from 0.5 to 5 hours. The molded article, which can maintain the shape thereof as a belt by itself, is released from the inner surface of the mold. The inner surface of the mold may be subjected to a releasing treatment upon releasing.

The molded article, which has been heated and cured to maintain the belt shape by itself, is put on an outer surface of a metallic cylinder, and the cylinder having the molded article carried thereon is heated to advance the imide conversion reaction. The metallic cylinder preferably has a larger linear thermal expansion coefficient than that of the polyimide resin. The outer diameter of the cylinder is made smaller than the inner diameter of the polyimide molded article by a prescribed amount, whereby heat set is carried out to obtain an endless belt having a uniform thickness without unevenness. The outer surface of the metallic cylinder preferably has a surface roughness Ra (average centerline roughness defined in JIS B0601) of from 1.2 to 2.0 $\mu$m. When the surface roughness Ra of the outer surface of the metallic cylinder is less than 1.2 $\mu$m, the metallic cylinder is too flat, and the resulting intermediate transfer belt does not skid upon shrinkage of the belt in the axial direction of the cylinder, whereby the belt is drawn in this step to provide such a tendency that fluctuation in thickness occurs, and the accuracy in flatness is lowered. When the surface roughness Ra of the outer surface of the metallic cylinder exceeds 2.0 $\mu$m, the outer surface of the metallic cylinder is transcribed to the inner surface of the belt intermediate transfer body to cause unevenness on the outer surface thereof, whereby image failures are liable to occur.

The heating conditions for imide conversion are preferably a heating temperature of from 220 to 280° C. and a heating time of from 0.5 to 2 hours while depending on the composition of the polyimide resin. The imide conversion under the heating conditions provide a large shrinking amount of the polyimide resin, and thus fluctuation in thickness and deterioration of accuracy of flatness can be prevented by gradually carrying out shrinkage in the axial direction of the belt.

The intermediate transfer belt formed with the polyimide resin thus obtained preferably has a surface roughness Ra on the outer surface thereof of 1.5 $\mu$m or less. When the surface roughness Ra of the intermediate transfer body exceeds 1.5 $\mu$m, a tendency occurs that image defects, such as husky images, are formed. The inventors estimate that the formation of husky images is caused by a reason that an electric field caused by voltage applied on transferring or electric discharge upon releasing is concentrated at protruded parts to degenerate the protruded parts, whereby the resistance is lowered due to the formation of new electroconductive paths, and as a result, the density of the resulting image is lowered.

The intermediate transfer belt 9 thus obtained is preferably a seamless belt. In the case of the seamless belt, the thickness of the intermediate transfer belt 9 may be appropriately determined depending on the purpose thereof, and it is preferably from 20 to 500 $\mu$m, and more preferably from 50 to 200 $\mu$m, from the standpoint of mechanical characteristics including strength and flexibility. The surface resistance of the intermediate transfer belt 9 is preferably such a value that provide a common logarithm of a surface resistivity thereof ($\Omega$ per square) of from 8 to 15 (log$\Omega$ per square), and more preferably from 11 to 13 (log$\Omega$ per square). The term surface resistivity referred to herein means a value obtained based on an electric current value measured in such a manner that a voltage of 100 V is applied under the environment of 22° C. and 55% RH, and the electric current value is measured 10 seconds after from the start of application of voltage.

According to this embodiment described in the foregoing, an electrostatic latent image is formed by irradiation of the charged photoreceptor 1, and the electrostatic latent image is developed to form a toner image on the surface of the photoreceptor. The toner image is primarily transferred from the photoreceptor 1 to the intermediate transfer belt 9 and then secondarily transferred from the intermediate transfer belt 9 to the transfer material. At this time, the photoreceptor 1 and the intermediate transfer body 9 satisfy the foregoing conditions of dynamic hardness of the surfaces thereof, whereby the toner image can be sufficiently uniformly transferred without damaging the photoreceptor and the intermediate transfer body. Therefore, occurrence of image defects, such as nibbled images, can be sufficiently prevented, and thus good images can be stably obtained for a long period of time.

The invention is not limited to the embodiment described in the foregoing. For example, the photoreceptor 1 can be unified with a cleaning device to be used as a process cartridge. At this time, the process cartridge may also be equipped with charging devices 2*a* to 2*d*, developing devices 4*a* to 4*d* and a transfer device including the backup roll 7, tension roll 8, intermediate transfer body 9, primary transfer rolls 10*a* to 10*d* and secondary transfer roll 13.

In the photoreceptor 1, the protective layer 25 contains a crosslinked material having such a skeleton that contains an organic group having charge transporting property, a silicon atom bonded to the same or different carbon atom in the organic group, and an oxygen atom bonded to the silicon atom, but a charge transporting material may be dispersed in a prescribed silicone resin to form a protective layer.

The photoreceptor 1 is a function-separated photoreceptor having a charge generating layer and a charge transporting layer independently provided, but a single-layer photoreceptor having a charge generating material and a charge transporting material in the same layer may be used as far as the dynamic hardness of the surface of the photoreceptor 1 satisfies the foregoing conditions.

An example of an apparatus for forming an image using color toners is exemplified in this embodiment, but the apparatus for forming an image according to the invention may be an apparatus for forming a black and white image using only a black toner.

The charging device 2 in the apparatus shown in FIG. 1 may be either a contact charging device, such as a charging roller, or a non-contact charging device, such as a corotron charging device. A contact charging device is preferred from the standpoint of prevention of ozone generation.

In the apparatus shown in FIG. 1, the exposing device 3 may be an optical system capable of imagewise exposing the surface of the electrophotographic photoreceptor 1 with a light source, a semiconductor laser, LED (light emitting diode) and a liquid crystal shutter. Examples of the transfer device include a contact transfer charging device, such as a belt, a roller, a film and a rubber blade, as well as a scorotron transfer charging device and a corotron transfer charging device utilizing corona discharge.

EXAMPLES

The invention will be described in more detail below with reference to examples and comparative examples shown below, but the invention is not construed as being limited to the examples.

Example 1

Production of Electrophotographic Photoreceptor

An outer surface of a drawing tube formed with an alloy of JIS A3003 (diameter: 30 mm, longitudinal length: 404 mm) is ground with a centerless grinding machine to make a surface roughness Rz (10-point average surface roughness defined in JIS B0601) of 0.6 μm. The surface is subjected to a degreasing treatment and then a honing treatment to obtain a cylindrical support having a surface roughness Ra of 0.2 μm.

20 parts by weight of a zirconium compound (Orgatics ZC540, produced by Matsumoto Chemical Co., Ltd.), 2.5 parts by weight of a silane compound (A1100, produced by Nippon Unicar Co., Ltd.) and a polyvinyl butyral resin (S-Lec BM-S, produced by Sekisui Chemical Co., Ltd.) are dissolved in 45 parts by weight of butanol to prepare a coating composition for forming an undercoating layer. The coating composition is coated on the outer surface of the support by a dip coating method and dried by heating at 150° C. for 10 minutes to form an undercoating layer having a thickness of 3 μm.

1 part by weight of chlorogallium phthalocyanine having distinct diffraction peaks at Bragg angles (2θ±0.2°) of 7.4°, 16.6°, 25.5° and 28.3° is mixed with 1 part by weight of a polyvinyl butyral resin (S-Lec BM-S, produced by Sekisui Chemical Co., Ltd.) and 100 parts by weight of n-butyl acetate, and the mixture is subjected to a dispersion treatment along with glass beads in a paint shaker for 1 hour to obtain a coating composition for forming a charge generating layer. The coating composition is coated on the undercoating layer by a dip coating method and dried by heating at 100° C. for 10 minutes to form a charge generating layer having a thickness of 0.15 μm.

2 parts by weight of a benzidine compound (Compound (V-27) in Table 3) and 3 parts by weight of a polymer compound represented by the following formula (31) (viscosity average molecular weight: 39,000) are dissolved in 20 parts by weight of chlorobenzene to prepare a coating composition for forming a charge transporting layer. The coating composition is coated on the charge generating layer by a dip coating method and dried by heating at 110° C. for 40 minutes to form a charge transporting layer having a thickness of 20 μm.

(31)

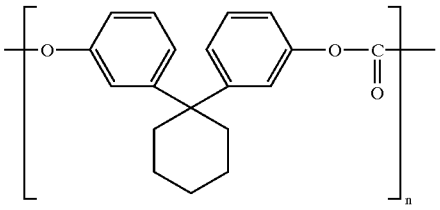

2 parts by weight of a compound represented by the following formula (32), 2 parts by weight of a compound represented by the following formula (33) and 0.5 part by weight of tetramethoxysilane are dissolved in a mixed solvent containing 5 parts by weight of isopropyl alcohol, 3 parts by weight of tetrahydrofuran and 0.3 part by weight of distilled water, and 0.05 part by weight of an ion exchange resin (Amberlyst 15E) is added thereto, followed by stirring at room temperature for 24 hours, to carry out electrolysis.

(32)

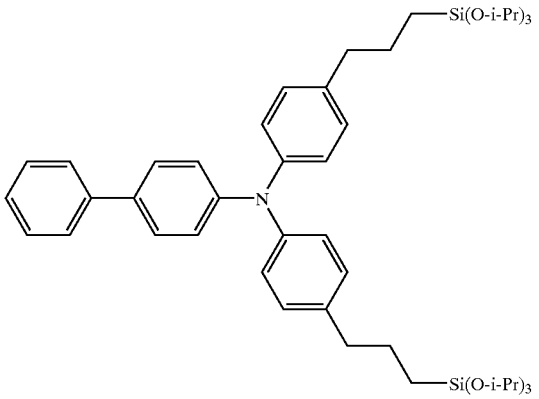

(33)

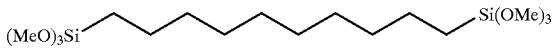

The ion exchange resin is removed by filtration from the reaction mixture after completing the electrolysis reaction to obtain a filtrate, and 0.04 part by weight of aluminum trisacetylacetonate and 0.1 part by weight of 3,5-di-t-butyl-4-hydroxytoluene (BTH) are added to 2 parts by weight of the filtrate to obtain a coating composition. The coating composition is coated on the charge transporting layer by a ring dip coating method, and the coated film is dried in air at room temperature for 30 minutes and cured by heating at 170° C. for 1 hour to form a protective layer having a thickness of 3 μm. Thus, an intended electrophotographic photoreceptor is obtained.

Production of Intermediate Transfer Belt 6 parts by weight of dried oxidized carbon black (Special Black 4, produced by Degussa AG) is added to 64 parts by weight of N-methylpyrrolidone (NMP) and mixed at room temperature with a ball mill. 22 parts by weight of 3,3',4,4'-biphenyltetracarboxylic acid dianhydride (BPDA) and 8 parts by weight of p-phenylene diamine (PDA) are dissolved in the resulting carbon black NMP dispersion, and they are reacted by stirring under a nitrogen atmosphere at room temperature for 4 hours to obtain a carbon black-containing polyamide acid NMP solution. The polyamide acid solution is coated on an inner surface of a cylindrical mold through a dispenser to a thickness of 400 μm, and then formed into a spread layer having a uniform thickness by rotating the mold at 1,500 rpm for 15 minutes. While the mold is rotated at 250 rpm, hot air at 60° C. is blown onto the outer surface of the mold for 30 minutes, and the mold is subsequently heated at 150° C. for 60 minutes, followed by cooling to room temperature, to effect molding.

A polyamide acid belt having been cured to have free-standing property is released from the inner surface of the mold and put on an outer surface of an aluminum cylinder having a surface roughness Ra of 1.8 μm, and the assembly is heated to 250° C. at a temperature increasing rate of 2° C. per minute. The assembly is maintained at 250° C. for 1 hour and then heated at a temperature increasing rate of 2° C. per minute to 300° C. for 30 minutes to complete the imide conversion reaction. The assembly is then cooled to room temperature to obtain an intended intermediate transfer belt (thickness: 75 μm).

Measurement of Dynamic Hardness

The photoreceptor and the intermediate transfer body thus obtained is measured for dynamic hardness by using a microhardness measuring apparatus (DUH-201, produced by Shimadzu Corp.) in an indenter penetration mode (stress velocity: 0.05 N/sec) (dynamic hardness A). The results obtained are shown in Table 8.

The protective layer and the intermediate transfer belt are formed on glass supports, respectively, and they are measured for dynamic hardness at a stress velocity of 0.09 N/sec (dynamic hardness B). The results obtained are shown in Table 8.

Production of Apparatus for Forming Image

An apparatus for forming an image having a structure shown in FIG. 1 is produced by using the photoreceptor and the intermediate transfer belt. In this Example, a charging device having a contact charging roll and a cleaning device having a cleaning blade made with polyurethane are used. Polyester toners of four colors, i.e., black, yellow, magenta and cyan, are used as toners to be supplied from the developing device.

A printing test of duplicating characters and lines is carried out by using the apparatus for forming an image. As a result, it has been confirmed that occurrence of dropout of images on the character part and thinning of the lines is sufficiently prevented, and good image quality can be obtained, even after printing 10,000 sheets.

Example 2

An intermediate transfer belt is produced in the same manner as in Example 1 except that in the production process of the intermediate transfer belt, oxydianiline (ODA) is used instead of p-phenylene diamine (PDA) in the polyamide acid solution in Example 1. The dynamic hardness of the surface of the resulting intermediate transfer belt is shown in Table 8.

An apparatus for forming an image is produced in the same manner as in Example 1 except that the intermediate transfer belt produced in this example is used, and the image quality is evaluated. As a result, it has been confirmed that occurrence of dropout of images on the character part and thinning of the lines is sufficiently prevented, and good image quality can be obtained, even after printing 15,000 sheets.

Example 3

An electrophotographic photoreceptor is produced in the same manner as in Example 1 except that in the production process of the photoreceptor, the drying temperature upon forming the protective layer is 120° C. and the drying time thereon is 1 hour. An intermediate transfer belt is produced in the same manner as in Example 2. The dynamic hardness values of the surfaces of the resulting photoreceptor and the intermediate transfer belt are shown in Table 8.

An apparatus for forming an image is produced in the same manner as in Example 1 except that the photoreceptor and the intermediate transfer belt produced in this example are used, and the image quality is evaluated. As a result, it has been confirmed that occurrence of dropout of images on the character part and thinning of the lines is sufficiently prevented, and good image quality can be obtained, even after printing 8,500 sheets.

Example 4

An electrophotographic photoreceptor is produced in the same manner as in Example 1 except that in the production process of the photoreceptor, 2 parts by weight of a compound represented by the following formula (34) is used instead of the compound represented by the formula (33). The dynamic hardness of the surface of the resulting photoreceptor is shown in Table 8.

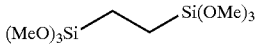

(34)

An apparatus for forming an image is produced in the same manner as in Example 1 except that the photoreceptor produced in this example is used, and the image quality is evaluated. As a result, it has been confirmed that occurrence of dropout of images on the character part and thinning of the lines is sufficiently prevented, and good image quality can be obtained, even after printing 10,000 sheets.

Comparative Example 1

An electrophotographic photoreceptor is produced in the same manner as in Example 1 except that the protective layer is not provided. The dynamic hardness of the surface of the resulting photoreceptor is shown in Table 8.

An apparatus for forming an image is produced in the same manner as in Example 1 except that the photoreceptor produced in this comparative example is used, and the image quality is evaluated. As a result, occurrence of dropout of images on the character part is found in the first sheet of printing, and good image quality cannot be obtained.

Comparative Example 2

An apparatus for forming an image is produced in the same manner as in Example 2 except that the photoreceptor produced in the same manner as in Comparative Example 1 is used, and the image quality is evaluated. As a result, occurrence of dropout of images on the character part is found in the first sheet of printing, and good image quality cannot be obtained.

Comparative Example 3

An intermediate transfer belt is produced by extrusion molding using a polycarbonate resin (bisphenol A type) and the same oxidized carbon black as in Example 1. The dynamic hardness of the surface of the resulting intermediate transfer belt is shown in Table 8.

An apparatus for forming an image is produced in the same manner as in Example 1 except that the intermediate transfer belt produced in this comparative example is used, and the image quality is evaluated. As a result, occurrence of dropout of images on the character part is found in the first sheet of printing, and good image quality cannot be obtained.

TABLE 8

| | Dynamic hardness A ($N/m^2$) | | | Dynamic hardness B ($N/m^2$) | | |
|---|---|---|---|---|---|---|
| | Photo-receptor (a) | Intermediate transfer belt (a') | Difference (a'-a) | Protective layer (b) | Intermediate transfer belt (b') | Difference (b'-b) |
| Example 1 | 13.1 | 30.2 | 17.1 | 17.3 | 31.2 | 13.9 |
| Example 1 | 13.1 | 26.0 | 12.9 | 17.3 | 24.1 | 6.8 |
| Example 1 | 10.5 | 26.0 | 15.5 | 16.8 | 24.1 | 7.3 |
| Example 1 | 17.0 | 30.2 | 13.2 | 23.5 | 31.2 | 7.7 |
| Comparative Example 1 | 7.2 | 30.2 | 23.0 | 8.9 (charge transporting layer) | 31.2 | 22.3 |
| Comparative Example 2 | 7.2 | 26.0 | 18.8 | 8.9 (charge transporting layer) | 24.1 | 15.2 |
| Comparative Example 3 | 13.1 | 11.0 | −2.1 | 17.3 | 11.0 | −6.3 |

As described in the foregoing, the apparatus for forming an image according to the invention uses a photoreceptor and an intermediate transfer body having such dynamic hardness values on the surfaces thereof that satisfy the conditions defined in the invention, whereby toner images can be sufficiently and uniformly transferred to the intermediate transfer body primarily without any damage of the photoreceptor and the intermediate transfer body. Therefore, by using the apparatus for forming an image of the invention, occurrence of image defects, such as nibbled images, can be sufficiently prevented, and images of good quality can be stably obtained for a long period of time.

The entire disclosure of Japanese Patent Application No. 2001-345252 filed on Nov. 9, 2001 including specification, claims, drawings and abstract is incorporated herein by reference in its entirety.

What is claimed is:

1. An apparatus for forming an image comprising:

an electrophotographic photoreceptor having an electroconductive support having formed thereon a photosensitive layer;

a charging unit that charges a surface of the photoreceptor;

an exposing unit that exposes the surface of the photoreceptor to form an electrostatic latent image;

a developing unit that develops the electrostatic latent image with a toner to form a toner image; and a transferring unit that primarily transfers the toner image to an intermediate transfer body and secondarily transfers a primary transferred image on the intermediate transfer body to a transfer material, wherein the surface of the photoreceptor has a dynamic hardness of $8\times10^9$ N/m$^2$ or more, a surface of the intermediate transfer body has a dynamic hardness larger than that of the surface of the photoreceptor, and the difference between the dynamic hardness of the surface of the photoreceptor and the dynamic hardness of the surface of the intermediate transfer body is $2\times10^{10}$ N/m$^2$ or less.

2. The apparatus for forming an image as claimed in claim 1, wherein the surface of the intermediate transfer body has a dynamic hardness of $1.8\times10^{10}$ N/m$^2$ or more.

3. The apparatus for forming an image as claimed in claim 1, wherein the photoreceptor further comprises a protective layer on a farther side from the support, and when the protective layer and the intermediate transfer body are formed on glass supports, respectively, the surface of the intermediate transfer body has a dynamic hardness larger than the dynamic hardness of a surface of the protective layer, and the difference between the dynamic hardness of the surface of the protective layer and the dynamic hardness of the surface of the intermediate transfer body is $1.5\times10^{10}$ N/m$^2$ or less.

4. The apparatus for forming an image as claimed in claim 3, wherein the protective layer contains a crosslinked material having a skeleton that contains an organic group having a charge transporting property, a silicon atom bonded to the same or a different carbon atom in the organic group, and an oxygen atom bonded to the silicon atom.

5. The apparatus for forming an image as claimed in claim 3, wherein the protective layer contains a polysiloxane resin having a charge transporting property and a crosslinked structure.

6. The apparatus for forming an image as claimed in claim 1, wherein the intermediate transfer body contains a polyimide resin.

7. A process for forming an image comprising:

charging an electrophotographic photoreceptor having a surface having a dynamic hardness of $8\times10^9$ N/m$^2$ or more;

exposing the charged surface of the electrophotographic photoreceptor to form an electrostatic latent image;

developing the electrophotographic latent image with a toner to form a toner image;

primarily transferring the toner image to an intermediate transfer body having a surface having a dynamic hardness larger than that of the surface of the photoreceptor, with the difference between the dynamic hardness of the surface of the photoreceptor and the dynamic hardness of the surface of the intermediate transfer body being $2\times10^{10}$ N/m$^2$ or less; and secondarily transferring a primary transferred image on the intermediate transfer body to a transfer material.

8. The process for forming an image as claimed in claim 7, wherein the surface of the intermediate transfer body has a dynamic hardness of $1.8\times10^{10}$ N/m$^2$ or more.

9. The process for forming an image as claimed in claim 7, wherein the photoreceptor further comprises a protective layer, and when the protective layer and the intermediate transfer body are formed on glass supports, respectively, the surface of the intermediate transfer body has a dynamic hardness larger than the dynamic hardness of a surface of the protective layer, and the difference between the dynamic hardness of the surface of the protective layer and the dynamic hardness of the surface of the intermediate transfer body is $1.5\times10^{10}$ N/m$^2$ or less.

10. The process for forming an image as claimed in claim 9, wherein the protective layer contains a crosslinked material having a skeleton that contains an organic group having a charge transporting property, a silicon atom bonded to the same or a different carbon atom in the organic group, and an oxygen atom bonded to the silicon atom.

11. The process for forming an image as claimed in claim 9, wherein the protective layer contains a polysiloxane resin having a charge transporting property and a crosslinked structure.

12. The process for forming an image as claimed in claim 7, wherein the intermediate transfer body contains a polyimide resin.

* * * * *